US008726704B2

(12) United States Patent
White

(10) Patent No.: US 8,726,704 B2
(45) Date of Patent: May 20, 2014

(54) SHELF WITH SECRET COMPARTMENT AND HIDDEN LOCKING SYSTEM

(76) Inventor: Brian Dale White, Henderson, NV (US)

( * ) Notice: Subject to any disclaimer, the term of this patent is extended or adjusted under 35 U.S.C. 154(b) by 13 days.

(21) Appl. No.: 13/557,135

(22) Filed: Jul. 24, 2012

(65) Prior Publication Data

US 2013/0025510 A1 Jan. 31, 2013

Related U.S. Application Data

(60) Provisional application No. 61/511,440, filed on Jul. 25, 2011.

(51) Int. Cl.
*E05B 65/52* (2006.01)
*E05B 47/00* (2006.01)

(52) U.S. Cl.
USPC ..... 70/63; 70/161; 70/276; 70/413; 109/48; 109/50; 206/317; 220/210; 220/230; 224/913; 248/553; 292/75; 292/159; 292/251.5

(58) Field of Classification Search
USPC ..... 70/63, 159–162, 276, 413; 292/73, 75, 292/77, 79, 137, 159, 251.5; 220/210, 230; 206/1.5, 317; 224/912, 913; 109/48, 109/50–52; 248/551–553
See application file for complete search history.

(56) References Cited

U.S. PATENT DOCUMENTS

| | | | | | |
|---|---|---|---|---|---|
| 1,402,209 | A | * | 1/1922 | Bulgach | 70/289 |
| 1,946,384 | A | * | 2/1934 | Baril et al. | 70/280 |
| 2,673,755 | A | * | 3/1954 | Asp | 292/78 |
| 2,956,828 | A | * | 10/1960 | Clark | 292/251.5 |
| 3,464,606 | A | * | 9/1969 | Nordeen | 224/281 |
| 3,893,723 | A | * | 7/1975 | Boule | 292/140 |
| 4,026,588 | A | * | 5/1977 | Bisbing et al. | 292/251.5 |
| 4,383,721 | A | * | 5/1983 | Knaack et al. | 312/290 |
| 4,651,544 | A | * | 3/1987 | Hungerford | 70/63 |
| 4,691,542 | A | * | 9/1987 | Young | 70/129 |
| 4,848,812 | A | * | 7/1989 | Slaughter | 292/144 |
| 5,076,623 | A | * | 12/1991 | Richards | 292/251.5 |
| 5,329,865 | A | * | 7/1994 | McWard | 109/50 |
| 5,407,261 | A | * | 4/1995 | Mercer | 312/248 |
| 5,484,092 | A | * | 1/1996 | Cheney | 224/404 |
| 5,760,689 | A | * | 6/1998 | Holmgren | 340/568.8 |
| 6,659,516 | B2 | * | 12/2003 | Wang et al. | 292/251.5 |
| 7,356,891 | B2 | * | 4/2008 | Freeman | 27/35 |
| 7,770,986 | B1 | * | 8/2010 | Simaitis | 312/247 |
| 7,854,321 | B2 | * | 12/2010 | Twig et al. | 206/373 |
| 7,959,241 | B2 | * | 6/2011 | Kohlmann et al. | 312/245 |
| 2012/0080890 | A1 | * | 4/2012 | Loret De Mola | 292/157 |

FOREIGN PATENT DOCUMENTS

| | | | |
|---|---|---|---|
| GB | 2145461 | * | 3/1985 |

* cited by examiner

*Primary Examiner* — Lloyd Gall
(74) *Attorney, Agent, or Firm* — Jennifer Riel; Riel Law

(57) ABSTRACT

A shelf device comprises an enclosed frame that includes a plurality of members, a concealed compartment within the frame, and a locking system that includes a locking mechanism comprising a slide bolt and magnetic lift positioned perpendicularly within the slide bolt, a ledge that is engaged with the slide bolt when the locking system is locked, and a magnet. The magnetic lift moves in one direction to cause the slide bolt to move perpendicularly to the magnetic lift's direction as the slide bolt disengages or engages with the ledge to unlock or lock the shelf, respectively. In one embodiment, a rare earth magnet is aligned with the magnetic lift to pull the magnetic lift vertically upward causing the slide bolt to move horizontally backward to disengage the slide bolt from the ledge. Consequently, the shelf is opened as one or more frame members are released to expose the concealed compartment.

16 Claims, 24 Drawing Sheets

SHELF WITH SECRET COMPARTMENT AND HIDDEN LOCKING SYSTEM

This application claims the benefit of priority under 35 U.S.C. §119 of provisional application Ser. No. 61/511,440, filed Jul. 25, 2011, the contents of which are hereby incorporated by reference.

FIELD OF THE INVENTION

The present invention relates generally to articles of furniture and fixtures and to a related locking system. More particularly, the present invention relates to a shelf device that functions as a typical shelf and includes a hidden locking system so that it also functions as a concealed storage compartment for firearms and other valuables.

BACKGROUND

Throughout the world, many people own guns or other valuables that they would like to conceal from both children and thieves. It is essential to keep guns safely hidden from children as their curiosity about the guns may lead to a harmful or deadly accident. It is also necessary to hide guns and other valuables from thieves that may burglarize a home.

There are many types of safes and cabinets that exist to store and lock such valuables; however, they are usually fairly conspicuous and do not conceal the mere fact of their presence in the home or other dwelling. Therefore, with such safes and cabinets, neither children nor thieves are ignorant of the presence of guns or other valuables. In fact, a safe would even attract a thief since most people obviously store valuable items in safes. Nevertheless, many thieves are familiar with the methods used to break into such safes and cabinets. This is especially true of devices that use common combination or electronic locks. Some of these devices are also very costly, so that they are not easily attainable, and many of these devices are simply eyesores, as they do not adequately blend in with a home's décor and furnishings. Additionally, many of these safes are not fully adaptable for storing a wide variety of items and, instead, are designed specifically for one type of item to be stored (e.g. guns, money or documents).

Drawbacks and Potential Improvements

Due to the aforementioned limitations in gun safe devices, there is a need in the art for a device to securely conceal firearms and other valuables that is completely undetectable to the ordinary person, child, or thief. What is needed is a device that looks completely inconspicuous with respect to its intended function (i.e., to securely conceal and store firearms and other valuables). The device should not only be secure and inconspicuous, but it should also be quickly accessible to the owner or rightful user of the firearms being concealed in the event immediate access is necessary as in an emergency situation. The device should also be versatile enough to contain a variety of items that one might want to conceal. In addition, this device should ideally be cost effective.

Many of the gun and storage devices for valuables that are designed to blend in with other furnishings have a number of drawbacks. Many of these storage devices are designed as pieces of furniture, such as tables, chests, armoires, curios, etc. However, when thieves or other persons are looking for items of value, it is most common to begin checking the drawers or other storage compartments of these types of furniture because it is the most obvious place to store items. Even with combination locks, key locks, or electronic locks in place, the persistent or skillful thief can find a way to eventually break or circumvent the lock or crack the code. On the other hand, since a hidden key has to be obtained or a multi-digit combination code has to be precisely programmed into a lock device, such locking mechanisms may take too much time to unlock should a gun owner need immediate access in the event of an emergency or life and death situation.

There are also devices that incorporate hidden storage inside the walls of a home that are concealed by pieces of art. While these devices are slightly more sophisticated, they are also considerably more costly, and they are not unknown to thieves as these types of safes are commonly depicted in motion pictures and television shows. Once again, commonplace combination locks and keypads used in these devices may not deter thieves or other persons looking to gain access to guns and valuables stored therein. These devices may sometimes be outfitted with more complex biometric locking mechanisms, but would be significantly more costly to the average person.

Furthermore, some gun and valuable storage devices are built into false walls and secret doorways. While these devices may be very effective at disguising their true purpose, they are extremely expensive due to the labor involved in creating and building a custom device for an individual home or other dwelling. This places such devices out of reach to a person who does not own their residence or the average person looking to safely and feasibly store guns and other valuables away from children and thieves.

A device that performs the functions and addresses the drawbacks explained above is likely to help a great number of people securely and inconspicuously store their guns and other valuables. Other advantages of the present invention will be apparent to one of ordinary skill in the art in light of the ensuing description of the present invention.

SUMMARY

The present invention is directed to a shelf with a concealed interior compartment in which firearms and valuables can be securely stored. The shelf functions like any other regular shelf on which a variety of items can be stored or displayed on top, and it also functions as a secret storage place in which valuables can be stored inside its interior hidden compartment. Not only is the shelf inconspicuous since there are no indications that a secret compartment exists therein and since it blends in with décor and furnishings, but it provides an imperceptible hiding place from children as well as thieves since it can be mounted in hard-to-reach or unobvious areas of a dwelling. The weight capacity and strength of the shelf allows it to efficiently store and conceal a variety of firearms and weapons, and its secret locking system provides the owner or rightful user quick access to the firearms and weapons during an emergency or life and death situation. The interior storage area of the shelf includes a removable panel that is capable of being customized with pegs, racks, trays, and/or other hardware to secure a wide variety of valuables (e.g., important documents such as passports and birth certificates, cash, jewelry, heirlooms, and other valuables) to which one may want quick access to in the event of an emergency or evacuation. The shelf also includes a locking system that is difficult to circumvent and offers a cost-effective and feasible alternative to the large, bulky and expensive safes and gun cabinets that are currently on the market. Another aspect of the present invention is directed to a hidden locking system for a secret compartment, and the locking system may be incorporated and used with various shelf devices, articles of furniture, cabinets, fixtures, containers, or any other item that provides a secret interior compartment or for which a hidden locking system is desired.

To achieve the foregoing and in accordance with the purposes of the present invention, one aspect of the present invention is directed to a shelf device that generally comprises an enclosed frame, a concealed interior compartment within the enclosed frame, and a locking system. Generally, when the shelf is in the closed position, the locking system is locked and holds the frame together to conceal the interior compartment; and when the shelf is being unlocked and opened, the locking system disengages and releases a portion of the frame to expose the interior compartment.

In one embodiment of the invention, the shelf device is comprised of: (a) a frame that includes a plurality of members, and (b) a locking system that includes (i) a locking mechanism comprised of a housing that encases a slide bolt and a magnetic lift, (ii) a ledge that is attached to the interior side of one of the frame members and that is engaged with the slide bolt of the locking mechanism when the locking system is locked (and the shelf device is in the closed position), and (iii) a magnet that unlocks the locking system by pulling the magnetic lift which moves the slide bolt away from the ledge to thereby disengage the ledge from the slide bolt. The magnet preferably possesses high strength such as a rare earth magnet and is not easily assessable via most retail outlets. The plurality of members that make up the frame may be comprised of: a left side member, a right side member, a front member, a bottom member, a top member, and a back member that are configured to form a rectangular prism-shaped concealed interior compartment inside of the enclosed frame. Some variations of the invention further include a mounting cleat to mount the shelf device to a wall and attaches to the rear side of the back member. In some embodiments, the frame further includes one or more arms that are attached to the bottomside of the top member and provides support for items stored on top of the shelf device (i.e., on the surface of the top member) and provides an attachment point for one or more pistons. The shelf also includes at least one hinge attached between one of the fixed members (i.e., members of the frame that do not move when the shelf is opened) and one of the moveable members (i.e., members of the frame that move when the shelf is opened). The shelf may also include at least one piston of which the piston's stationary end is attached to one of the fixed members of the frame, and the piston's telescoping end is attached to one of the moveable members of the frame. In a further embodiment, the shelf device may additionally include a removable panel that fits inside the interior compartment. The panel includes at least one side adapted for the attachment of pegs and other hardware, for use in securing and organizing items placed inside the compartment.

In one variation of the invention, both the top and back members of the frame (as well as the arms that are attached underneath the top member) are fixed members; and the left side, right side, front, and bottom members of the frame are moveable members. At least one hinge is attached between the back member and the bottom member, and the frame also includes a piston. The piston's stationary end is attached to the outer side of one of the arms, and the piston's telescoping end is attached to the interior side of the side member that is closest to the arm to which the piston's stationary end is attached. When the shelf is unlocked and opened, the left side, right side, front, and bottom members collectively disengage and are released from the fixed top and back members so that the user can access the interior compartment of the shelf. The left side, right side, front, and bottom members are permanently adjoined to one another and collectively form a tray-like structure, which securely holds the firearms or valuables as the shelf is being opened. In other version of the invention, the front member and the bottom member are permanently adjoined to each other. While in alternate variations of the invention, the fixed members and moveable members may vary (e.g., the top member may be a moveable member, and the left side, right side, front, bottom, and back members may all be fixed members).

Another aspect of the present invention is directed to a locking system comprised of (i) a locking mechanism that includes a housing that encases a slide bolt and a magnetic lift, (ii) a ledge that is attached to the interior side of one of the frame members and that is engaged with the locking system is locked, and (iii) a magnet such as a rare earth magnet. The locking mechanism includes a housing that is comprised of at least two housing components that are attached to one another after the slide bolt and magnetic lift are placed therein during the production process. The housing encases a slide bolt that is positioned perpendicularly to a magnetic lift. When the locking mechanism is being unlocked or locked, the magnetic lift moves in one direction to cause the slide bolt to move perpendicularly to the magnetic lift's direction as the slide bolt ultimately disengages or engages with the ledge to unlock or lock the locking system, respectively. In one embodiment of the invention, the slide bolt is positioned horizontally and the magnetic lift is positioned vertically within the housing. The slide bolt includes a slit, and the magnetic lift is positioned perpendicularly inside the slit of the slide bolt so that the slide bolt and magnetic lift are inter-engaged with one another. The magnetic lift includes an aperture through which a rolling assembly, which is comprised of a pin and one or more rollers, resides to assist the magnetic lift to smoothly move vertically within the slide bolt and to assist the slide bolt to move horizontally. The magnetic lift's aperture may be oval in shape and configured at a 45-degree angle in relation to the slide bolt to simultaneously permit both the horizontal movement of the slide bolt and the vertical movement of the magnetic lift. The aperture of the magnetic lift runs diagonally along the faces of the magnetic lift.

The locking mechanism may be attached to the interior side of any of the fixed members of the frame. For example, in the embodiment of the invention described above, the locking mechanism is attached to the bottomside of the top member, and the ledge is attached to the interior side of the front member (which is a moveable member and permanently adjoined to the left side, right side, and bottom members). The ledge is attached to the interior side of the front member so that the ledge is engaged with the slide bolt of the locking mechanism while the locking system is locked. To operate the locking system, a specific type of magnet (such as an industrial strength rare earth magnet which is not easily obtainable at typical hardware stores and other retail outlets) is placed on the surface of the top member of the frame and in direct alignment with the magnetic lift. The magnet pulls the magnetic lift vertically upward causing the slide bolt to move horizontally backward to release the slide bolt from the ledge. As a result, the shelf is opened as the front member (along with the left side, right side, and bottom member to which the front member is adjoined to) is released and drops down from the top member to expose the interior compartment. The user then closes the shelf (by re-engaging the moveable members of the frame with the fixed members) and the user can then use the magnet to reposition the slide bolt to lock the locking system. This slide bolt is engaged with the ledge in the locked position, disengages with the ledge while the locking system is being unlocked, and easily reengages with the ledge when the locking system is being relocked.

The above description sets forth a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in further detail, it is to be understood that the invention is not limited in its application to the details of the construction and to the arrangement of the components set forth in the following description or as illustrated in the drawings. The invention is capable of other embodiments and of being practiced and carried out in various ways. Furthermore, it is to be understood that the phraseology and terminology employed herein are for the purpose of description and should not be regarded as limiting.

Other features, aspects, and advantages of the present invention will become apparent from the following description of the invention, taken in conjunction with the accompanying drawings, which illustrate, by way of example, various features of embodiments of the invention.

DESCRIPTION OF THE INVENTION

Figure 2:
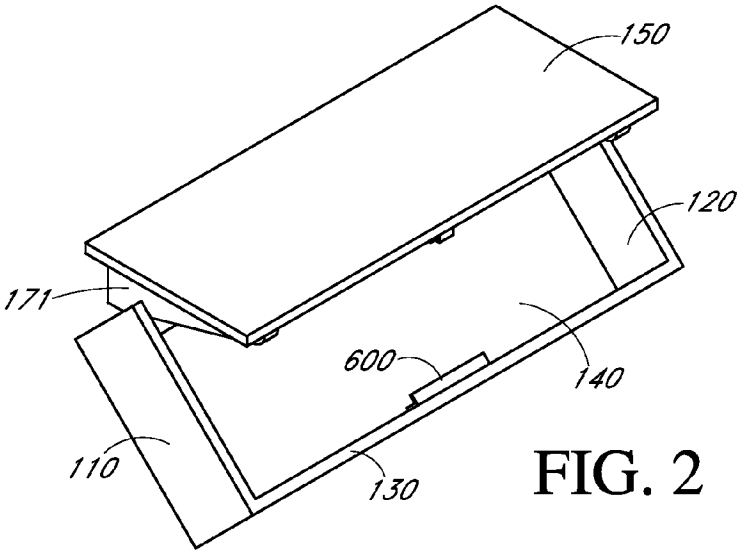
FIG. 2 depicts a perspective view of the shelf device shown in FIG. 1 with some parts omitted for clarity of illustration and shows the shelf device in the opened position.

In the following description of embodiments of the invention, reference is made to the accompanying drawings, which form a part of this application. The drawings show, by way of illustration, certain embodiments in which the invention may be practiced. It is to be understood that other embodiments may be utilized and modifications may be made without departing from the scope of the present invention. Also, it is to be understood that the phraseology and terminology employed herein are for the purpose of description and should not be regarded as limiting.

Generally, the present invention is directed to a shelf device that comprises: (a) an enclosed frame that includes a plurality of members that are configured to form a concealed interior compartment within the enclosed frame, and (b) a locking system comprised of (i) a locking mechanism that includes a housing that encases a slide bolt and a magnetic lift, (ii) a ledge that is engaged with the locking mechanism when the shelf is closed, and (iii) a magnet such as a rare earth magnet. In a further embodiment, the shelf may additionally comprise a removable panel that fits inside the compartment, which includes at least one side adapted for the attachment of pegs and other hardware, for use in securing and organizing items placed inside the compartment. Another aspect of the present invention is directed to a hidden locking system for a secret interior compartment and is comprised of a locking mechanism, a ledge, and a magnet. Said locking mechanism may be incorporated and used with different articles of furniture, shelf devices, fixtures, cabinets, containers, or any other item that provides a secret interior compartment.

When the shelf is in the closed position, the locking system is locked and holds the frame together to conceal the interior compartment; and when the shelf is being unlocked and opened, the locking system disengages and releases a portion of the frame (i.e., one or more members of the frame) to expose the interior compartment. The locking mechanism includes a housing that encases a slide bolt and a magnetic lift. The slide bolt includes a slit, and the magnetic lift is positioned perpendicularly within the slit of the slide bolt. The magnetic lift moves in one direction to cause the slide bolt to move perpendicularly to the magnetic lift's direction as the slide bolt disengages or engages with the ledge to unlock or lock the shelf, respectively. In one embodiment of the invention, the slide bolt is positioned horizontally, and the magnetic lift is positioned vertically and perpendicularly within the slit of the slide bolt. To unlock the shelf, a powerful type of magnet such as a rare earth magnet is aligned (outside of the frame) with the magnetic lift to pull the magnetic lift vertically upward causing the slide bolt to move horizontally away from the ledge to disengage the slide bolt from the ledge. Consequently, the shelf is opened as one or more members of the frame are released to expose the interior compartment.

Shelf Device Frame

Figure 1:
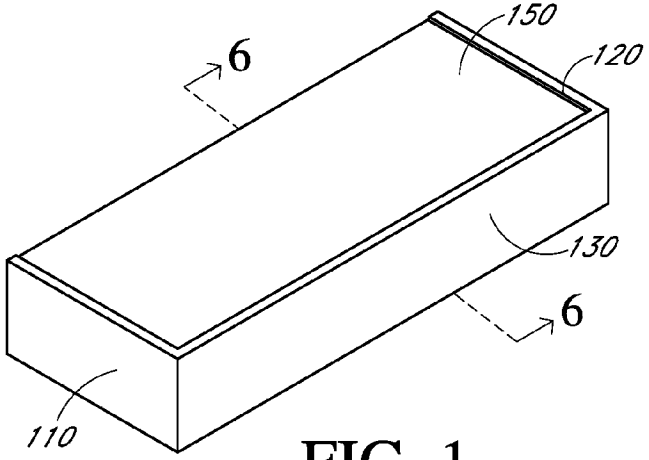
FIG. 1 depicts a perspective view of a shelf device in accordance with an embodiment of the present invention, showing the shelf device in the closed position.
Figure 3:
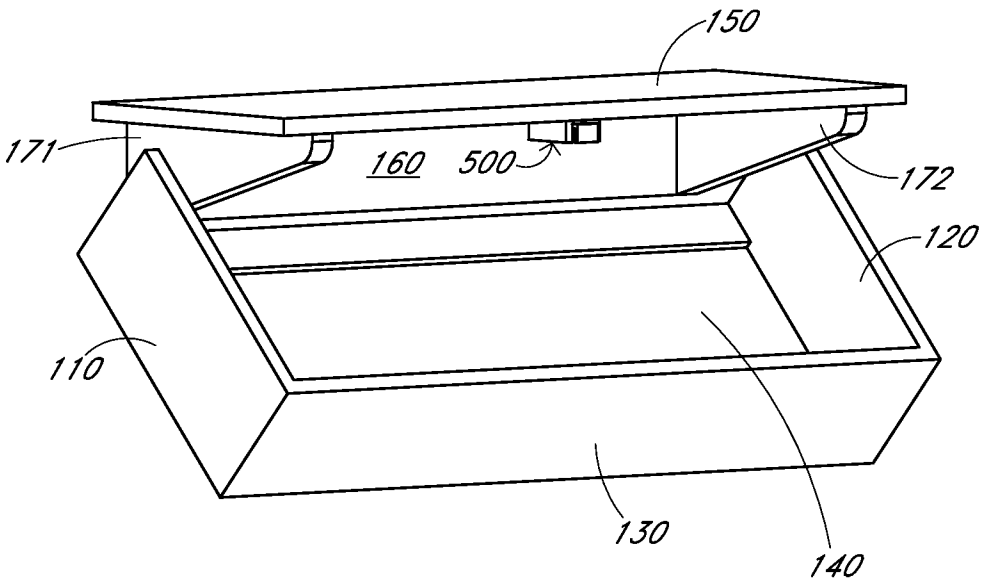
FIG. 3 depicts another perspective view of the shelf device shown in FIG. 1 with some parts omitted for clarity of illustration and shows the shelf device in the opened position.

FIG. 1 depicts a perspective view of a shelf device in the closed position in accordance with an embodiment of the present invention; and FIGS. 2-3 depict perspective views of the shelf device in the opened position with some parts omitted for clarity of illustration of the shelf device frame. As seen in FIGS. 1-3, the frame is comprised of: a left side member 110, a right side member 120, a front member 130, a bottom member 140, a top member 150, and a back member 160. In the embodiment of the invention shown in FIGS. 1-3, the following pairs of frame members may be comprised of the same rectangular shape and dimensions (i.e., length and width) and are positioned parallel to one another: (i) left side member 110 and right side member 120, and (ii) bottom member 140 and top member 150. Left side member 110, right side member 120, front member 130, bottom member 140, top member 150, and back member 160 are configured to form a rectangular prism wherein a concealed compartment is formed therein. As long as the lengths and widths of the foregoing paired members are the same, a rectangular prism may be formed even if the thickness of each of the members varies. However, since the shelf device is mounted onto a wall or other suitable surface via back member 160 and/or via a mounting cleat attached on the rear side of back member 160, back member 160 is unseen when the shelf is closed so that left side member 110 and right side member 120 are positioned flush against the wall when the shelf device is installed. Thus, back member 160 may be comprised of different dimensions than front member 130. The dimensions (length and/or width) of back member 160 may be less than the dimensions of front member 130 so that back member 160 does not protrude past left side member 110 and/or right side member 120 or protrude past top member 150 and/or bottom member 140, thereby maintaining the rectangular prism shape when the shelf is in the closed position.

Figure 4:
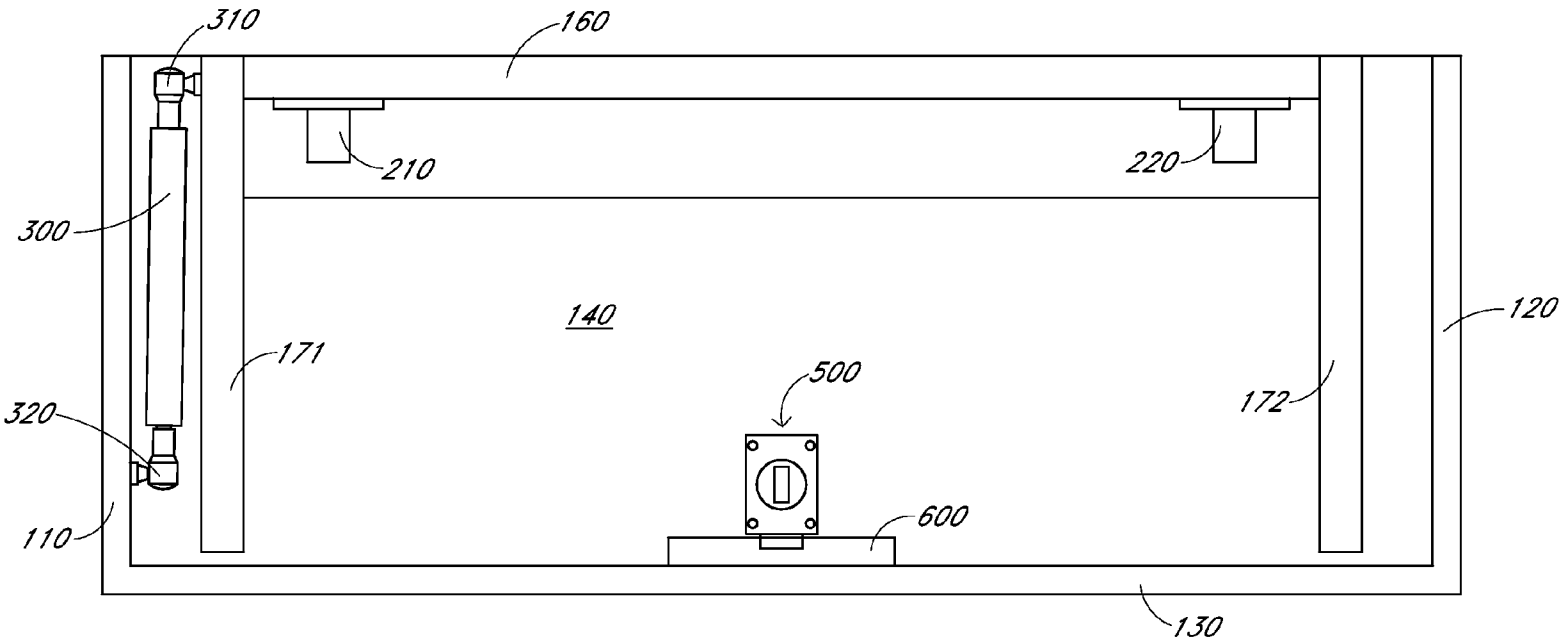
FIG. 4 depicts a top plan view of the shelf device shown in FIG. 1, with the top member of the shelf device omitted for clarity of illustration.
Figure 5:
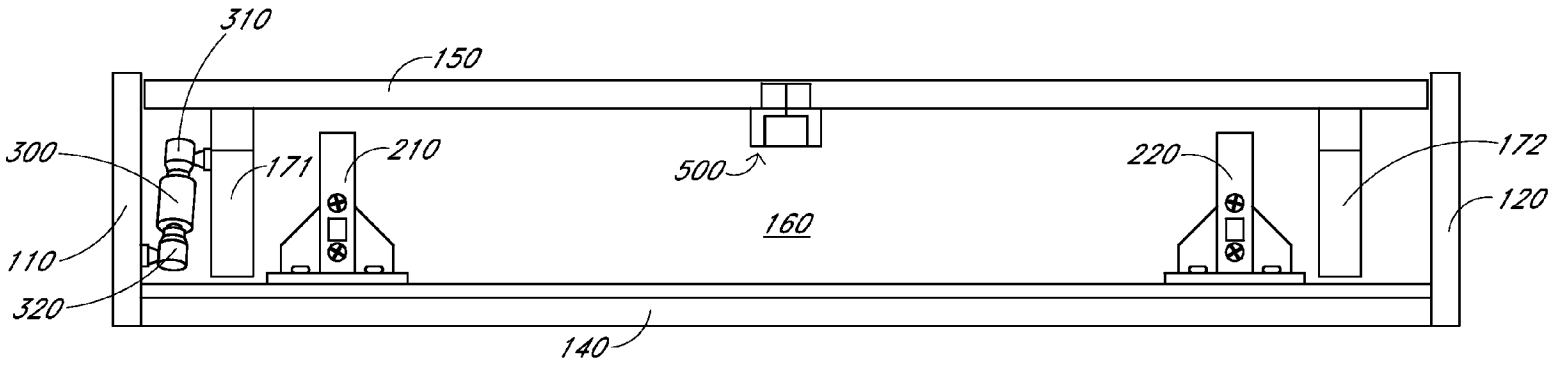
FIG. 5 depicts a front elevational view of the shelf device shown in FIG. 1, with the front member of the shelf device omitted for clarity of illustration.
Figure 6:
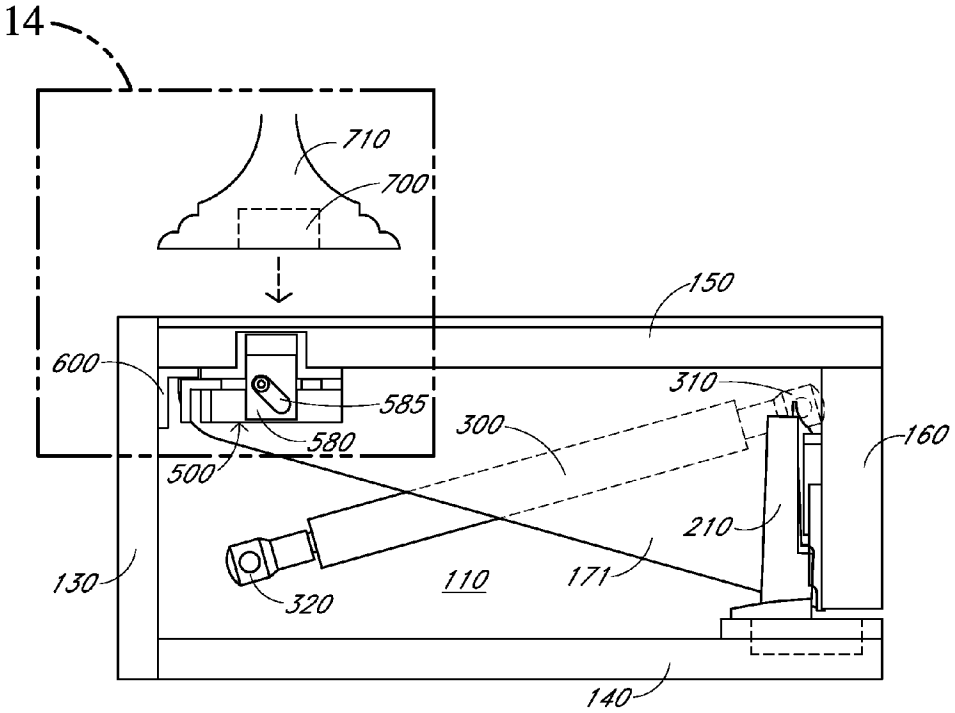
FIG. 6 depicts a sectional view of the shelf device taken along line 6-6 of FIG. 1.
Figure 7:
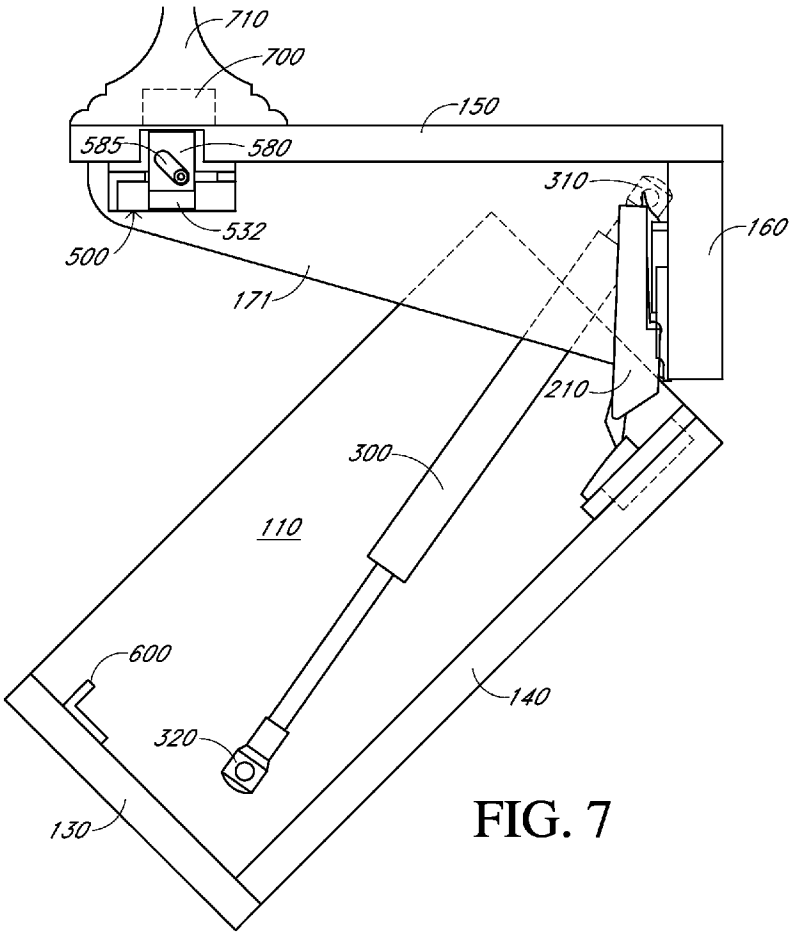
FIG. 7 depicts a sectional view of the shelf device as shown in FIG. 6, but illustrates the shelf device in the opened position.

FIG. 4 depicts a top plan view of the shelf device shown in FIG. 1 in the closed position with top member 150 of the frame omitted for clarity of illustration of the elements within the shelf. FIG. 5 depicts a front elevational view of the shelf device in the closed position with front member 130 of the frame omitted for clarity of illustration of the elements within the shelf. FIG. 6 depicts a sectional view of the shelf in the closed position wherein the sectional view is taken along line 6-6 of FIG. 1; while FIG. 7 depicts a sectional view of the shelf device as shown in FIG. 6, but shows the shelf device in the opened position.

FIGS. 4-5 illustrate left side member 110 and right side member 120, which are of the same shape and dimension, positioned opposite of and parallel to one another. As shown in FIGS. 4-6 bottom member 140 comprises the entire bottom surface of the shelf device of the present invention. As shown in FIGS. 5-6, top member 150 and bottom member 140 are of the same shape and dimension and are positioned opposite of and parallel to one another. However, the embodiment of the invention depicted in FIGS. 4 and 6 includes back member 160 of smaller dimensions than front member 130. As seen in FIG. 4, back member 160 is smaller in length than front member 130 so back member 160 does not protrude past left side member 110 and/or right side member 120, thereby maintaining the rectangular prism shape of the shelf in the closed position. As seen in FIG. 6, back member 160 is smaller in width than front member 130 so back member 160 does not protrude past top member 150 and/or bottom member 140, thereby maintaining the rectangular prism shape of the shelf in the closed position.

Referring to FIGS. 3-5, the frame may further include a first arm 171 and a second arm 172 that are attached perpendicularly to the bottomside of top member 150 to provide support for the shelf. As shown in FIGS. 4-5, first arm 171 and second arm 172 are parallel to both left side member 110 and right side member 120. In alternate variations of the invention such as those that include a longer top member 150 and bottom member 140 and/or variations of the invention that are intended to be used as a shelf for heavy items, the frame may include additional arms mounted perpendicularly underneath top member 150 to provide further support.

The frame of the shelf of the present invention also includes one or more hinges attached between one of the "fixed members" (i.e., members of the frame that do not move when the shelf is opened) and one of the "moveable members" (i.e., members of the frame that move and are released when the shelf is opened). Additionally, the frame of the shelf may also include at least one piston of which the piston's stationary end is attached to one of the fixed members of the frame, and the piston's telescoping end is attached to one of the moveable members of the frame.

For instance, in the embodiment of the invention shown in FIGS. 1-7, top member 150 and back member 160 of the frame (as well as first arm 171 and second arm 172 that are attached perpendicularly underneath top member 150) are all fixed members; and left side member 110, right side member 120, front member 130, and bottom member 140 of the frame are moveable members. As shown in FIGS. 4-5, a first hinge 210 and a second hinge 220 are attached between back member 160 and bottom member 140 (see also FIGS. 6-7 which illustrates a sectional view of first hinge 210). As depicted in FIGS. 4-7, piston 300 includes a stationary end 310 that is attached to the outer side of first arm 171 and a telescoping end 320 that is attached to the interior side of left side member 110.

Referring now to FIGS. 2, 3, and 7, when the shelf is opened, left side member 110, right side member 120, front member 130, and bottom member 140 collectively disengage and are released from fixed top member 150 and from fixed back member 160 so that the user can access the interior compartment of the shelf. Left side member 110, right side member 120, front member 130, and bottom member 140 are permanently adjoined to one another and collectively form a tray-like structure, which securely holds the firearms or valuables as the shelf is opened.

In additional embodiments of the present invention, left side member 110, right side member 120, front member 130, bottom member 140, and/or top member 150 may further include decorative elements and/or be shaped and dimensioned to form an aesthetically pleasing design. For instance, in some embodiments of the invention, removable and replaceable decorative elements may be attached to the visible surfaces of left side member 110, right side member 120, front member 130, bottom member 140, and/or top member 150.

Yet, in other embodiments of the invention, left side member 110, right side member 120, front member 130, bottom member 140, and/or top member 150 are shaped and dimensioned to form an aesthetically pleasing design. For example, FIGS. 16-22 depict an embodiment of the invention in which the outer surfaces of left side member 110, right side member 120, and front member 130 are shaped to form a molding design. FIGS. 28-32 depicts another embodiment of the invention in which the outer surfaces of left side member 110, right side member 120, and front member 130 are also shaped to form a molding design. In the embodiments shown in FIGS. 16-22 and in FIGS. 28-32, the shelf device frame has a traditional molding design. In the embodiment shown in FIGS. 1-7, the shelf device frame is shaped like a rectangular prism comprised of flat surfaces thereby having a more contemporary design.

Figure 17:
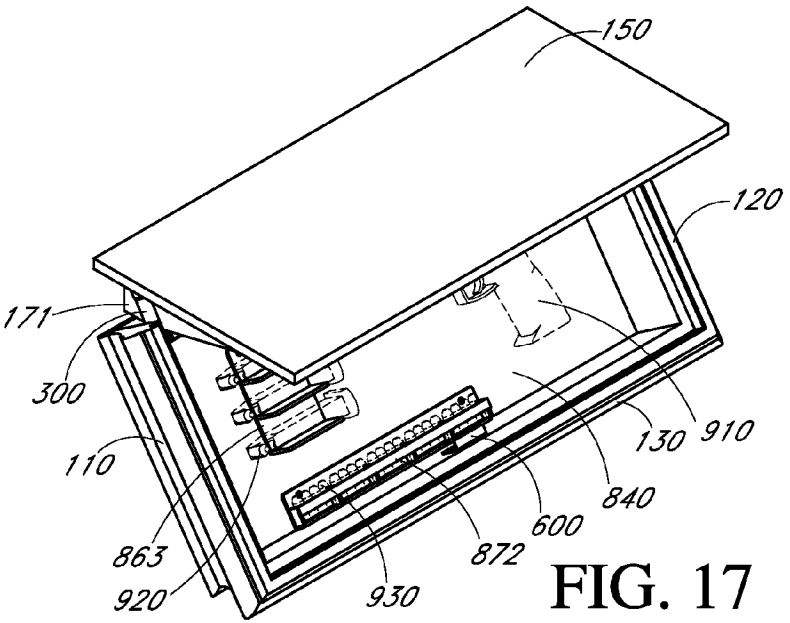
FIG. 17 depicts a perspective view of the shelf device shown in FIG. 16, showing the shelf device in the opened position.
Figure 16:
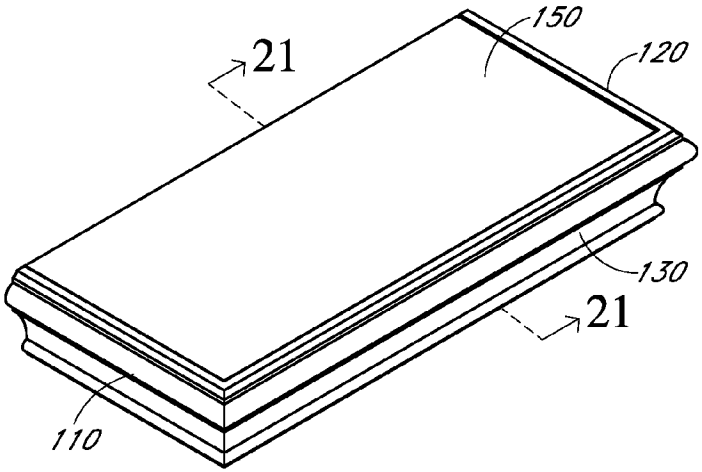
FIG. 16 depicts a perspective view of a shelf device in accordance with an embodiment of the present invention, showing the shelf device in the closed position.
Figure 18:
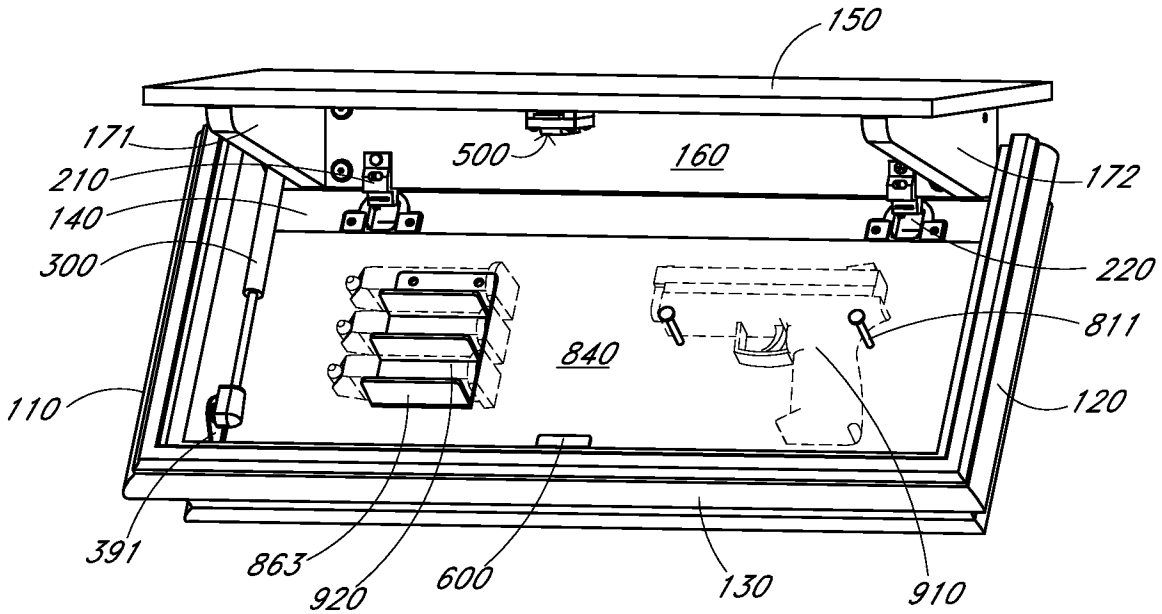
FIG. 18 depicts another perspective view of the shelf device shown in FIG. 16, showing the shelf device in the opened position.

FIG. 16 depicts a perspective view of the shelf device in the closed position, and FIGS. 17-18 depict perspective views of the shelf device in the opened position. The frame of the shelf device is comprised of left side member 110, right side member 120, front member 130, bottom member 140, top member 150, and back member 160. In this embodiment of the invention, the outer surfaces of left side member 110, right side member 120, and front member 130 are also shaped to form a molding design. Left side member 110, right side member 120, front member 130, bottom member 140, top member 150, and back member 160 are designed to look like a typical shelf, but are configured to form a concealed compartment therein. As shown in FIGS. 17-18, valuables such as a pistol 910 held by a display peg 811, a magazine 920 held by a multi-tiered utility shelf 863, and pistol ammunition 930 held by a pistol ammunition rack 872 may be securely hidden and quickly accessed via said concealed compartment. Such firearms, ammunition and valuables may be securely attached to a panel 840 which can be customized and configured with a variety of accessories (such as display peg 811, multi-tiered utility shelf 863, and pistol ammunition rack 872) that can securely hold various items such as firearms, ammunition, magazines, jewelry, cash, passports, important documents, etc. (see also FIGS. 33-35 described in more detail below).

Figure 19:
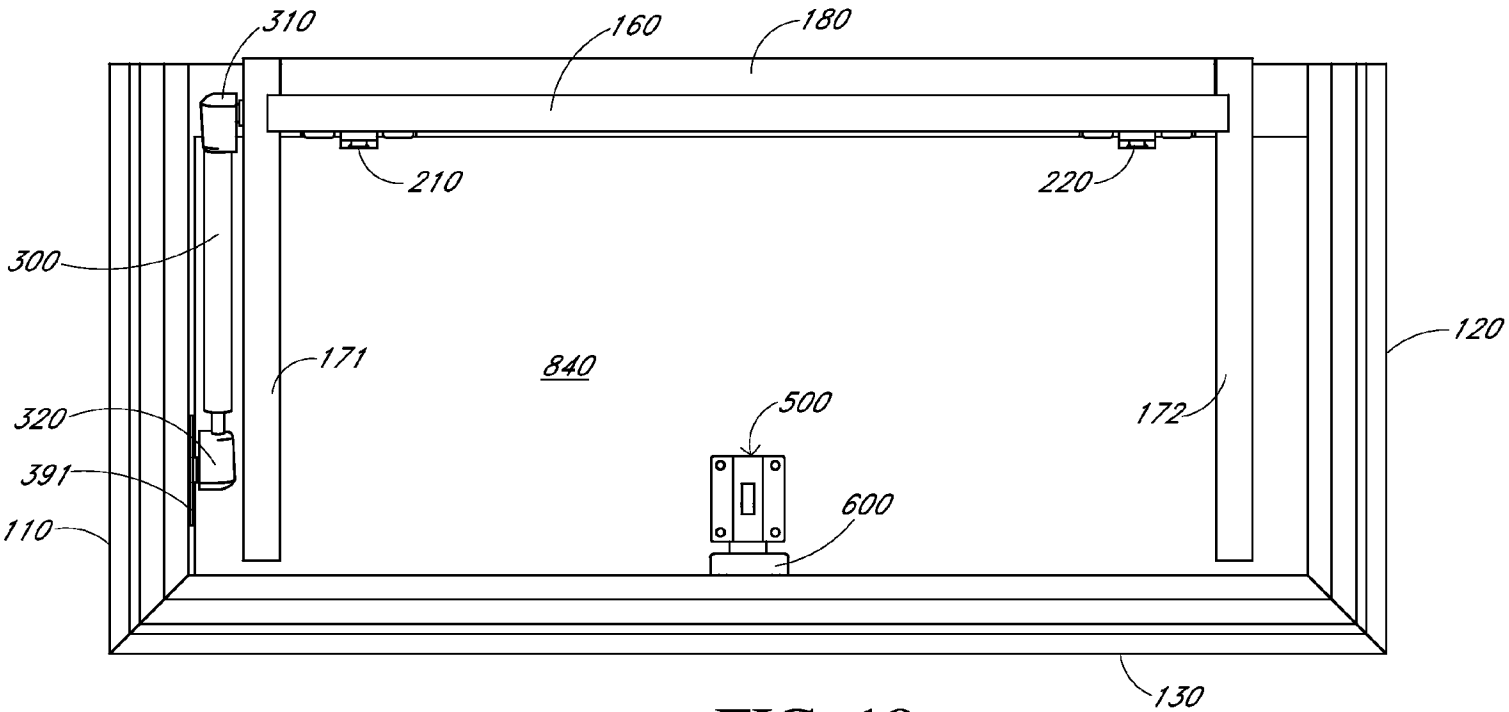
FIG. 19 depicts a top plan view of the shelf device shown in FIG. 16, with the top member of the shelf device omitted for clarity of illustration.
Figure 20:
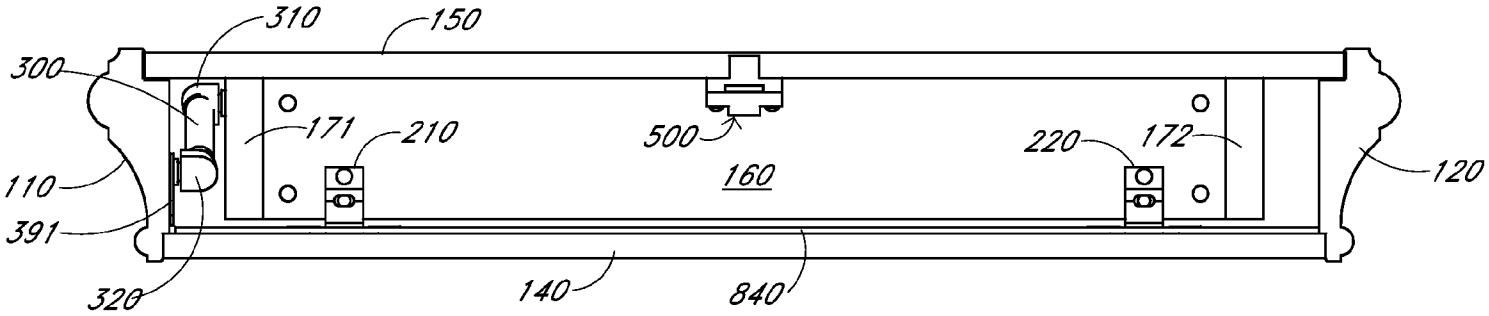
FIG. 20 depicts a front elevational view of the shelf device shown in FIG. 16, with the front member of the shelf device omitted for clarity of illustration.
Figure 21:
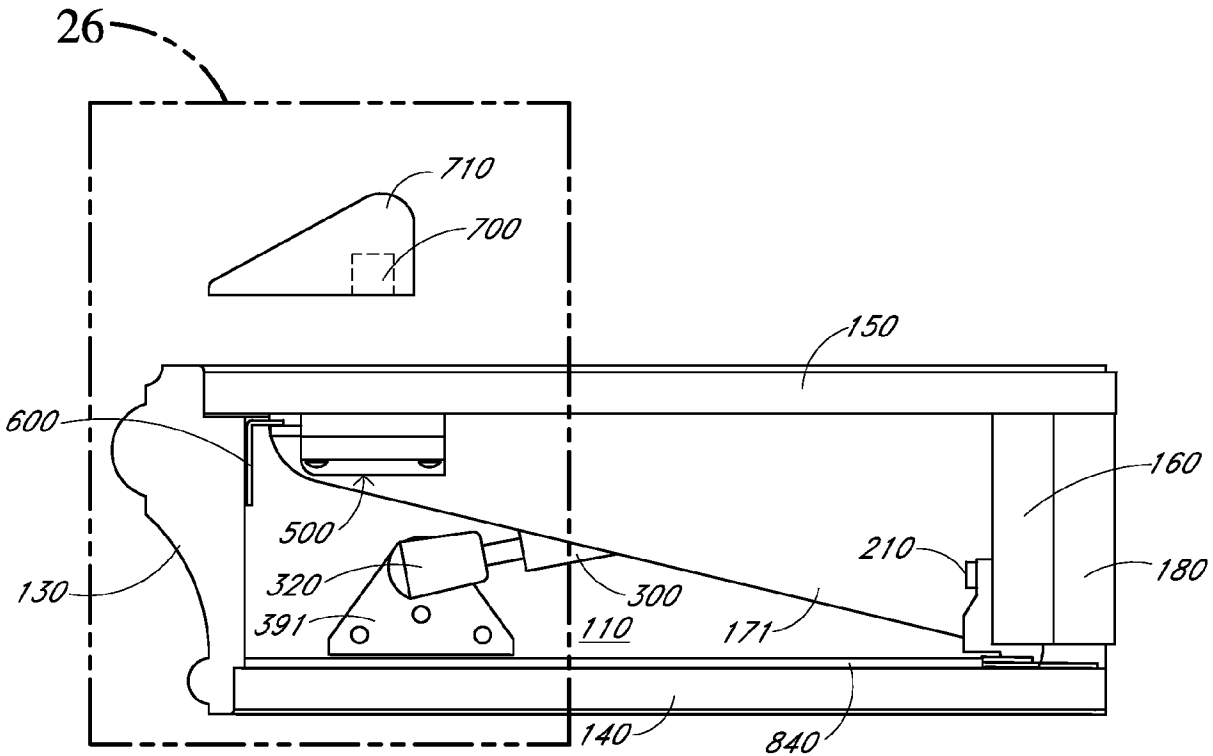
FIG. 21 depicts a sectional view of the shelf device taken along line 21-21 of FIG. 16.
Figure 22:
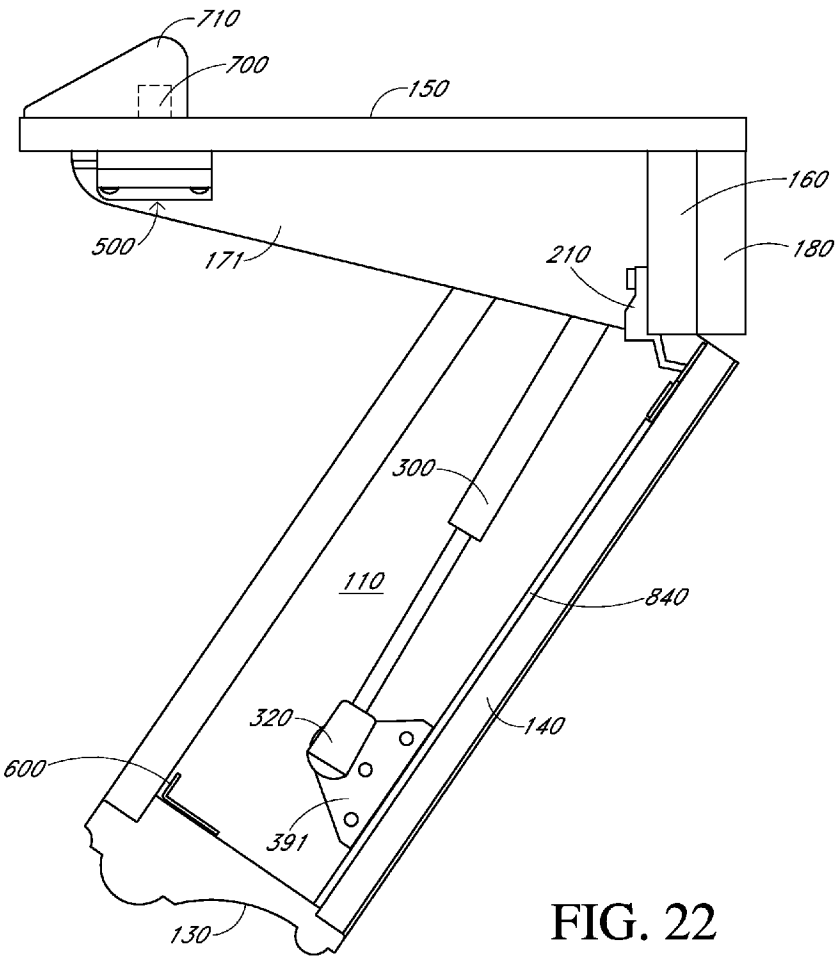
FIG. 22 depicts a sectional view of the shelf device as shown in FIG. 21, but illustrates the shelf device in the opened position.

FIG. 19 depicts a top plan view of the shelf device in the closed position with top member 150 of the frame omitted for clarity of illustration of the elements inside the shelf; and FIG. 20 depicts a front elevational view of the shelf device in the closed position with front member 130 of the frame omitted for clarity of illustration of the elements inside the shelf. FIG. 21 depicts a sectional view of the shelf in the closed position wherein the sectional view is taken along line 21-21 of FIG. 16; while FIG. 22 depicts a sectional view of the shelf device as shown in FIG. 21, but shows the shelf device in the opened position.

FIGS. 19-20 illustrate the following pairs of members positioned opposite of and parallel to one another to form compartment therein: left side member 110 and right side member 120; bottom member 140 and top member 150; and front member 130 and back member 160. FIG. 19 illustrates that back member 160 has a smaller length than front member 130 so back member 160 does not protrude past left side member 110 and/or right side member 120, thereby allowing left side member 110 and right side member 120 to be positioned flush against a wall when the shelf device is installed onto a wall and is in the closed position. As shown in FIGS. 19, 21 and 22, back member 160 is attached to a mounting cleat 180 to allow for the secure mounting of the shelf device onto a wall.

The shelf device of the present invention may be mounted to the wall by attaching mounting cleat 180 to the wall at the point of existing studs to provide stability, placing the open shelf device which is comprised of left side member 110, right side member 120, front member 130, bottom member 140, top member 150, and back member 160 onto mounting cleat 180 such that back member 160 is placed against mounting cleat 180, and screwing in bolts through back member 160 to secure the shelf device to mounting cleat 180. The shelf device can then be closed by applying upward pressure to bottom member 140 of the shelf device until locking mechanism 500 engages with ledge 600 (see also FIGS. 18 and 22). In some embodiments of the invention, magnet 700 may be used to assist with the engagement of locking mechanism 500 with ledge 600 to thereby close the shelf device.

As seen FIGS. 18-20, the frame may further include first arm 171 and second arm 172 that are attached to the bottom-side of top member 150 to provide support for the shelf. As seen in FIGS. 19-20, first arm 171 and second arm 172 are parallel to both left side member 110 and right side member 120. In alternate variations of the invention such as those that include a longer top member 150 and longer bottom member 140 and/or variations of the invention that are intended to be used as a shelf for heavy items, the frame may include additional arms mounted perpendicularly underneath top member 150 to provide further support.

In the embodiment of the invention shown in FIGS. 16-22, top member 150 and back member 160 of the frame (as well as first arm 171 and second arm 172 that are attached perpendicularly underneath top member 150) are all fixed members; and left side member 110, right side member 120, front member 130, and bottom member 140 of the frame are moveable members. As shown in FIGS. 19-20, first hinge 210 and second hinge 220 are attached between back member 160 and bottom member 140 (see also FIGS. 21-22 which illustrates a sectional view of first hinge 210). As illustrated in FIGS. 19-20, piston 300 includes stationary end 310 that is attached to the outer side of first arm 171 and a telescoping end 320 that is attached to the interior side of left side member 110. Telescoping end 320 of piston 300 is attached to the interior side via a piston mounting bracket 391 which is directly attached to the interior side of left side member 110 as shown in FIGS. 18-22.

Referring now to FIGS. 17, 18, and 22, when the shelf of the present invention is opened, left side member 110, right side member 120, front member 130, and bottom member 140 collectively disengage and are released from fixed top member 150 and from fixed back member 160 so that the user can access the interior compartment of the shelf. Left side member 110, right side member 120, front member 130, and bottom member 140 are permanently adjoined to one another and collectively form a tray-like structure, which securely holds the firearms or valuables as the shelf is opened.

Although only two hinges and one piston are depicted in each of the two embodiments of the invention illustrated in FIGS. 1-7 and FIGS. 16-22, in alternate embodiments, the present invention may include one or more additional hinges and/or pistons. For example, FIGS. 28-32 depict an alternate embodiment of the invention that is adapted to hold larger and/or heavier items within its interior compartment, and the shelf device of this embodiment includes a third hinge 230 and second piston 350 as shown in FIGS. 29-32 and further described below.

Figure 29:
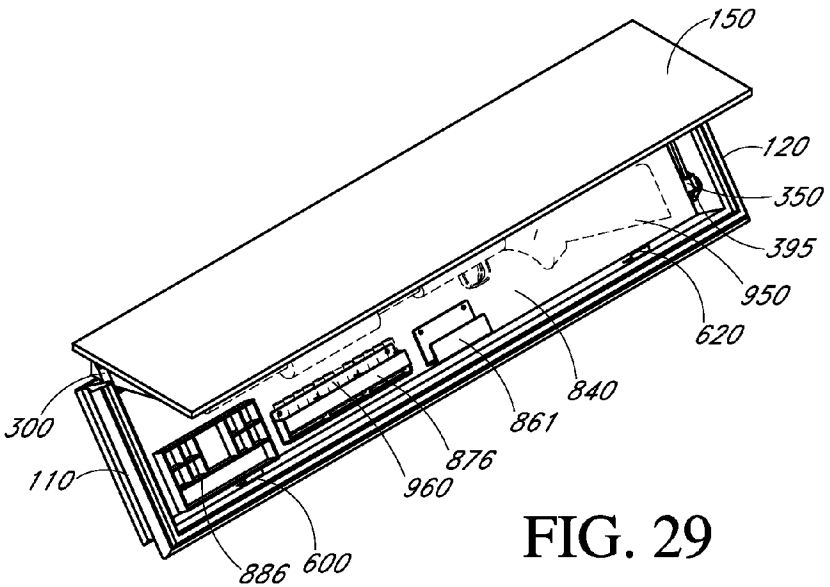
FIG. 29 depicts a perspective view of the shelf device shown in FIG. 28, showing the shelf device in the opened position.
Figure 28:
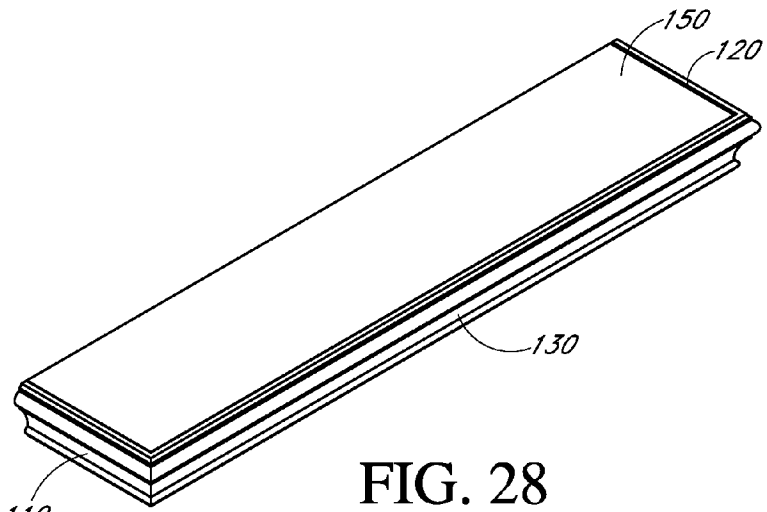
FIG. 28 depicts a perspective view of a shelf device in accordance with an embodiment of the present invention, showing the shelf device in the closed position.
Figure 30:
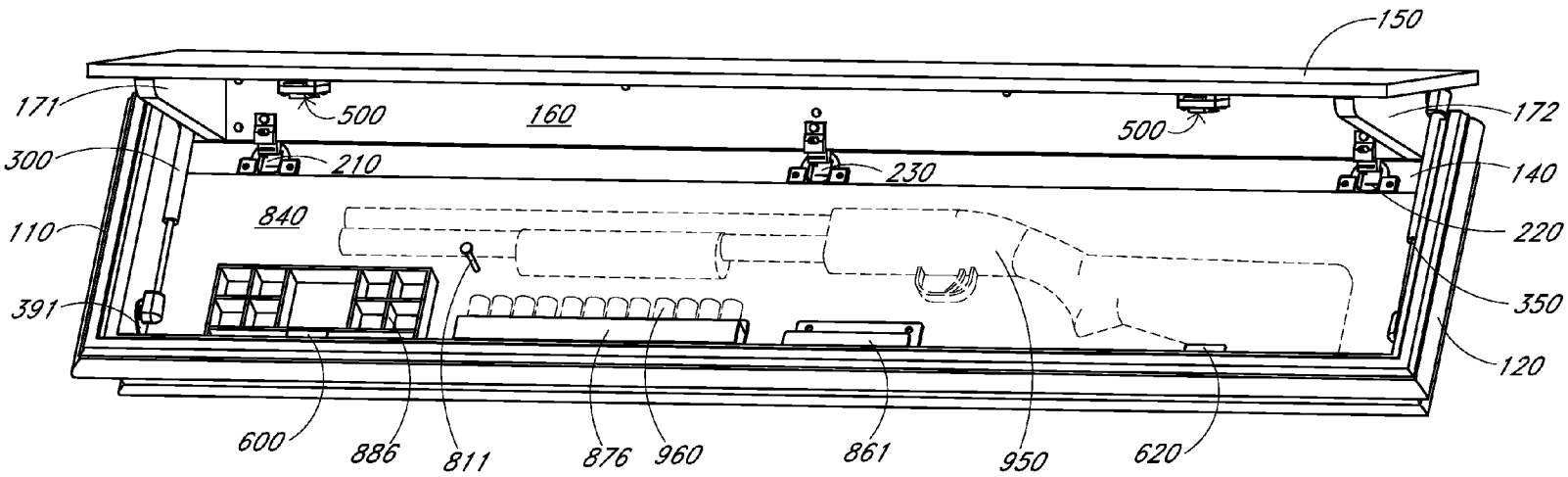
FIG. 30 depicts another perspective view of the shelf device shown in FIG. 28, showing the shelf device in the opened position.

FIG. 28 depicts a perspective view of the shelf device in the closed position, and FIGS. 29-30 depict perspective views of the shelf device in the opened position. The frame of the shelf device is comprised of left side member 110, right side member 120, front member 130, bottom member 140, top member 150, and back member 160. In this embodiment (as in the embodiment shown in FIGS. 16-20), the outer surfaces of left side member 110, right side member 120, and front member 130 are shaped to form a molding design. However, the embodiment shown in FIGS. 28-32 is comprised of top member 150 and bottom member 140 that are longer than the top member 150 and the bottom member 140 of the embodiment depicted in FIGS. 16-20. Thus, the longer top member 150 and longer bottom member 140 can accommodate larger and/or more items than what can be accommodated in the in the embodiment shown in FIGS. 16-20.

Left side member 110, right side member 120, front member 130, bottom member 140, top member 150, and back member 160 are designed to look like a typical shelf, but are configured to form a concealed compartment therein. As shown in FIGS. 29-30, valuables such as a shotgun 950 held by display peg 811 and shotgun ammunition 960 held by shotgun ammunition rack 876 may be securely hidden and quickly accessed via said concealed compartment. Such firearms, ammunition and valuables may be securely attached to panel 840 which can be customized and configured with a variety of accessories (such as display peg 811 and shotgun ammunition rack 876) that can securely hold various items such as firearms, ammunition, magazines, jewelry, cash, passports, important documents, etc. (see also FIGS. 33-35 described in more detail below).

Figure 31:
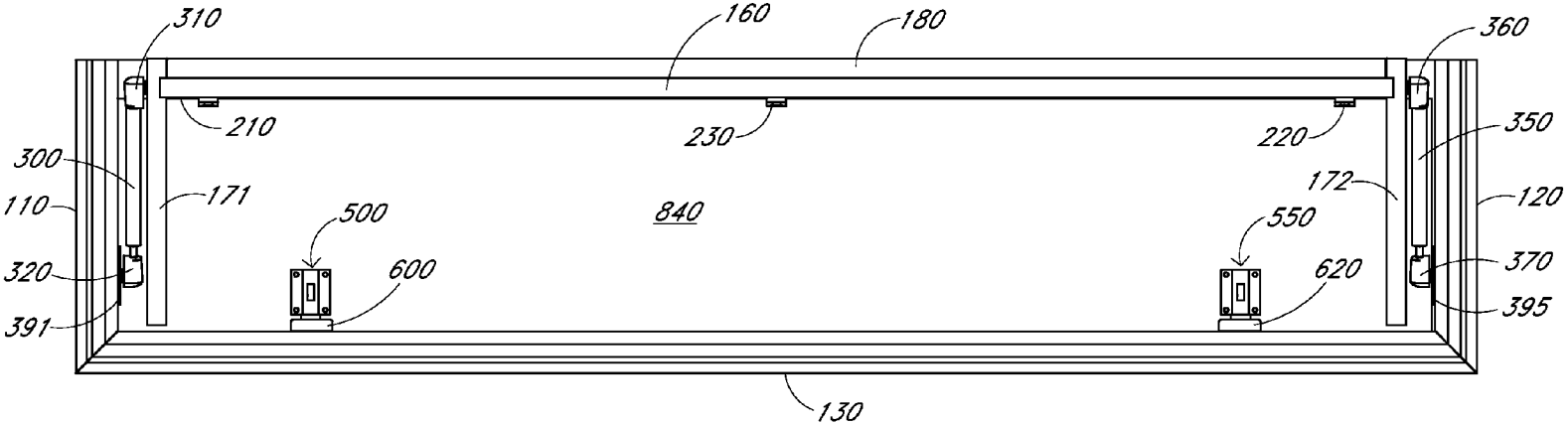
FIG. 31 depicts a top plan view of the shelf device shown in FIG. 28, with the top member of the shelf device omitted for clarity of illustration.
Figure 32:
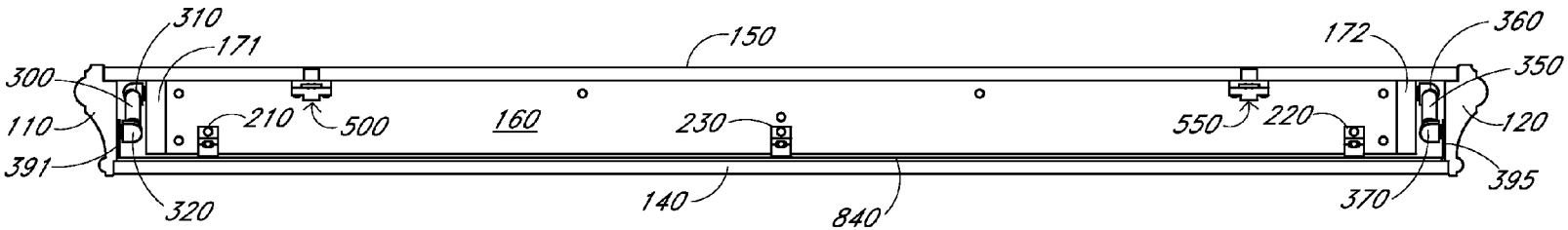
FIG. 32 depicts a front elevational view of the shelf device shown in FIG. 28, with the front member of the shelf device omitted for clarity of illustration.

FIG. 31 depicts a top plan view of the shelf device in the closed position with top member 150 of the frame omitted for clarity of illustration of the elements inside the shelf; and FIG. 32 depicts a front elevational view of the shelf device in the closed position with front member 130 of the frame omitted for clarity of illustration of the elements inside the shelf. FIGS. 31-32 illustrate the following pairs of members positioned opposite of and parallel to one another to form compartment therein: left side member 110 and right side member 120; bottom member 140 and top member 150; and front member 130 and back member 160. FIG. 31 illustrates that back member 160 has a smaller length than front member 130 so back member 160 does not protrude past left side member 110 and/or right side member 120, thereby allowing left side member 110 and right side member 120 to be positioned flush against a wall when the shelf device is installed onto a wall and is in the closed position. As shown in FIG. 31, back member 160 is attached to mounting cleat 180 to allow for the secure mounting of the shelf device onto a wall.

The shelf device of the present invention may be mounted to the wall by attaching mounting cleat 180 to the wall at the point of existing studs to provide stability, placing the open shelf device which is comprised of left side member 110, right side member 120, front member 130, bottom member 140, top member 150, and back member 160 onto mounting cleat 180 such that back member 160 is placed against mounting cleat 180, and screwing in bolts through back member 160 to secure the shelf device to mounting cleat 180. Said shelf device can then be closed by applying upward pressure to bottom member 140 of the shelf device until locking mechanism 500 and second locking mechanism 550 engages with ledge 600 and second ledge 620, respectively (see also FIG. 30). In some embodiments of the invention, magnet 700 may be used to assist with the engagement of locking mechanism 500 and second locking mechanism 550 with ledge 600 and second ledge 620 to thereby close the shelf device.

As shown in FIGS. 30-32, the frame further includes first arm 171 and second arm 172 that are attached perpendicularly to the bottomside of top member 150 to provide support for the shelf and acts as an attachment point for piston 300 and second piston 350. First arm 171 and second arm 172 are parallel to both left side member 110 and right side member 120, respectively.

As illustrated in FIGS. 30-32, the shelf device of the invention is comprised of first hinge 210, second hinge 220, and third hinge 230 which are attached between back member 160 and bottom member 140 and allows left side member 110, right side member 120, front member 130, and bottom member 140 to collectively drop down and expose the concealed interior compartment when the shelf device is being opened.

Referring to FIGS. 30-32, the shelf device includes piston 300 and second piston 350. As seen in FIGS. 31-32, piston 300 includes stationary end 310 that is attached to the outer side of first arm 171 and a telescoping end 320 that is attached to the interior side of left side member 110. Telescoping end 320 of piston 300 is attached to the interior side of left side member 110 via a piston mounting bracket 391 which is directly attached to the interior side of left side member 110 as shown in FIGS. 30-32. Second piston 350 includes stationary end 360 that is attached to the outer side of second arm 172 and a telescoping end 370 that is attached to the interior side of right side member 120. Telescoping end 370 of piston 350 is attached to the interior side of right side member 120 via a second piston mounting bracket 395 which is directly attached to the interior side of right side member 120 as shown in FIGS. 31-32. The use of second piston 350 is ideal for this embodiment of the invention since top member 150 and bottom member 140 are longer in length and therefore heavier (than the embodiments depicted in FIGS. 1-7 and in FIGS. 16-22) and since the size of this embodiment allows it to accommodate larger and heavier firearms and other valuables.

Referring to FIGS. 29 and 30, when the shelf of the present invention is opened, left side member 110, right side member 120, front member 130, and bottom member 140 collectively disengage and are released from fixed top member 150 and from fixed back member 160 so that the user can access the interior compartment of the shelf. Left side member 110, right side member 120, front member 130, and bottom member 140 are permanently adjoined to one another and collectively form a tray-like structure which securely holds the firearms and valuables in place as the shelf is opened.

In the embodiments of the invention described above and illustrated in the accompanying figures, top member 150 and back member 160 of the frame (as well as first arm 171 and second arm 172 that are attached perpendicularly underneath top member 150) are all fixed members; and left side member 110, right side member 120, front member 130, and bottom member 140 of the frame are moveable members. However, in alternate variations of the invention, the fixed members and moveable members may vary. For example, in one variation of the invention, top member 150 may be moveable; and left side member 110, right side member 120, front member 130, and bottom member 140 may be fixed members. In such variations, left side member 110, right side member 120, front member 130, and bottom member 140 are permanently adjoined to one another. When the shelf is unlocked and opened, top member 150 is disengaged upward from left side member 110, right side member 120, and front member 130.

In additional embodiments of the shelf device of the present invention, the interior compartment and/or panel 840 may be lined and/or padded to securely hold, to protect, to prevent scratches, and to prevent slippage of the firearms and valuables while the shelf is being opened. For instance, the interior side of bottom member 140 or the interior sides of left side member 110, right side member 120, front member 130, and bottom member 140 may be lined and/or padded using any suitable material known in the art such as foam, rubber, soft textiles such as velvet or felt, silicone, gel, polypropylene, polyurethane, polyethylene, or combinations thereof. The interior compartment may also include specially adapted or specially designed structures (made of the foregoing materials or any suitable material known in the art) to receive and securely hold a certain type of firearm or weapon and ammunition. Examples of such specially adapted structures may include egg crate foam, foam and/or rubber inserts to accommodate a particular firearm, die-cut interiors, etc.

In some embodiments of the invention, the interior compartment is easily customizable by configuring and attaching a variety of interchangeable and removable accessories to panel 840 which is illustrated in FIGS. 18 and 30. Such accessories can securely hold various items such as firearms, ammunition, magazines for firearms, jewelry, cash, passports, important documents, etc.

Figure 33:
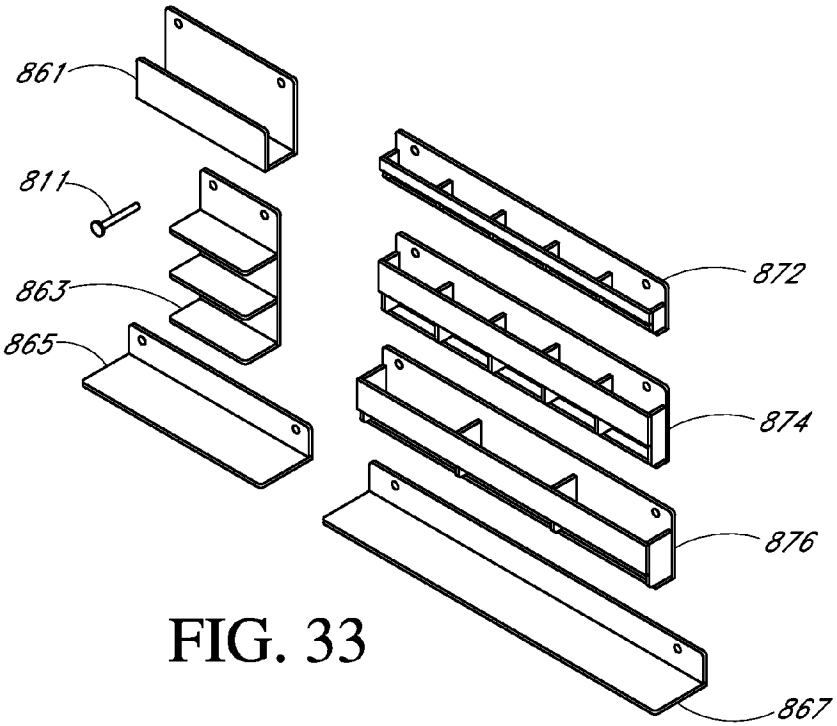
FIG. 33 depicts a perspective view of accessories that may be attached to a panel of a shelf device in accordance with an embodiment of the present invention.

For example, FIG. 33 depicts a display peg 811, a cash, passport, wallet holder 861, a multi-tiered utility shelf 863, a small utility shelf 865, a large utility shelf 867, a pistol ammunition rack 872, a rifle ammunition rack 874, and a shotgun ammunition rack 876 for use in attaching to panel 840 (see also FIGS. 18, 30 and 35) to customize the storage configuration of the interior compartment formed by the left side member 110, right side member 120, front member 130, bottom member 140 and back member 160 (see also FIGS. 2, 3, 17, 18, 29-31). The accessories may be shaped, dimensioned, designed and/or configured to accommodate any variety of firearms, ammunition, jewelry, documents and other valuables.

Figure 34:
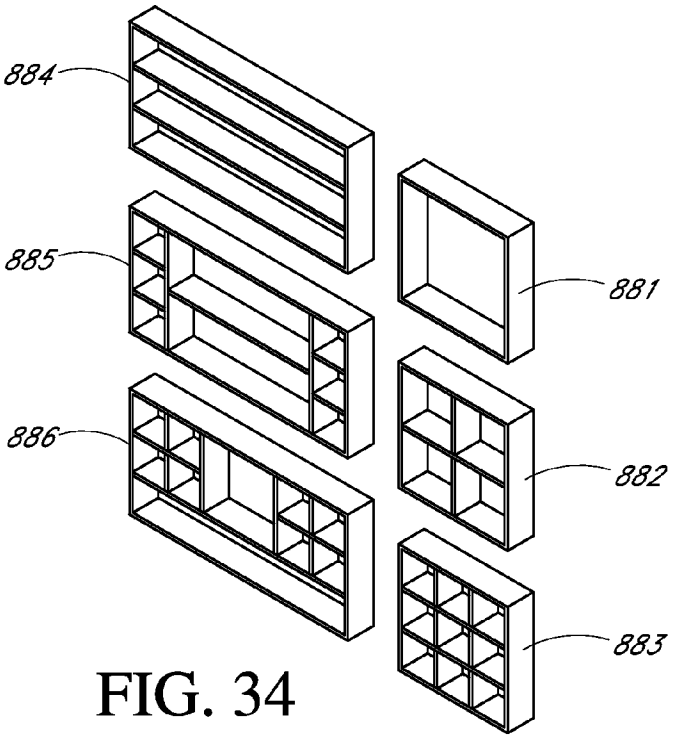
FIG. 34 depicts a perspective view of jewelry accessories that may be attached to a panel of a shelf device in accordance with an embodiment of the present invention.

FIG. 34 illustrates the following examples of various jewelry trays: a bracelet jewelry tray 881, a large earring jewelry tray 882, a ring jewelry tray 883, a necklace jewelry tray 884, a first multipurpose jewelry tray 885, and a second multipurpose jewelry tray 886 for use in attaching to the panel 840 (see also FIGS. 18, 30 and 35) to customize the storage configuration of the interior compartment formed by the left side member 110, right side member 120, front member 130, bottom member 140 and back member 160 (see also FIGS. 2, 3, 17, 18, 29-31). The accessories may be shaped, dimensioned, designed and/or configured to accommodate any variety of jewelry and other valuables.

Figure 35:
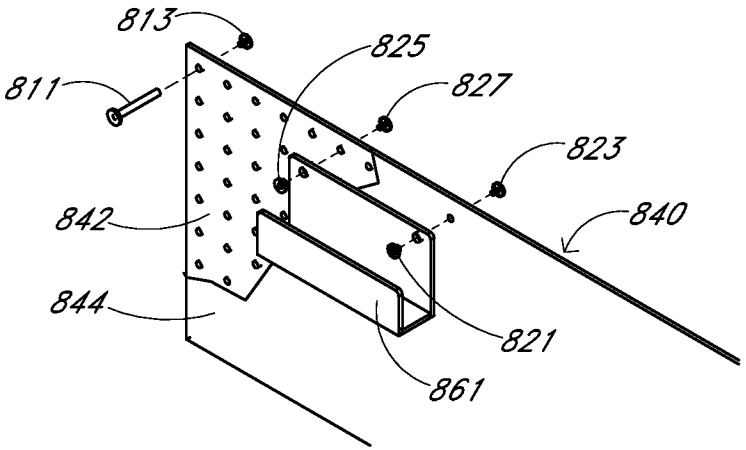
FIG. 35 depicts a perspective cut-away view of a portion of a panel of a shelf device in accordance with an embodiment of the present invention.

FIG. 35 depicts a perspective cut-away view of a portion of a panel 840 which is comprised of pegboard 842 with one side of pegboard 842 covered by a liner 844. Pegboard 842 may be comprised of any suitable pegboard known in the art and the type selected may depend on the items to be stored in the interior compartment. For example, in one embodiment of the invention, pegboard 842 is comprised of ⅛" MASONITE® pegboard with ⅛" holes on 1" centers. Of course, any other suitable pegboard of various dimensions may be used with the present invention. Liner 844 can be chosen from a variety of materials including but not limited to faux leather, vinyl, utility rubber, silicone rubber, foam, leather, suede, felted cloth, or any combination thereof. However, liner 844 may be omitted in other versions of the invention.

To customize the interior compartment formed by the left side member 110, right side member 120, front member 130, bottom member 140, and back member 160 of the shelf device frame discussed above, panel 840 is removed from bottom member 140. In versions of the invention that include liner 844, the user flips panel 840 over to access the predrilled holes of the exposed pegboard 842 which is on the backside of panel 840 as shown in the cut-away illustration of panel 840 in FIG. 35. Panel 840 can be customized by piercing through liner 844 from the predrilled holes on the backside of panel 840. Thus, pegboard 842 is pierced from the backside of panel 840 to penetrate liner 844 on the front side of panel 840.

Once the liner 844 is pierced in the configuration desired, any of the accessories illustrated in FIGS. 33 and 34 may be attached to panel 840 to accommodate a variety of firearms, ammunition, jewelry, cash, documents, and other valuables. For instance, display peg 811 and a display peg cap 813 may be attached as shown in FIG. 35 in which display peg penetrates liner 844 and passes through a hole of pegboard 842 and is secured by display peg cap 813 on the backside of panel 840. Display peg 811 may be used along with one or more additional display pegs to securely hold and display a wide variety of items such as a pistol or shotgun as shown in FIGS. 18 and 30. Additionally, a binding screw 821, binding screw cap 823, a second binding screw 825, and a second binding screw cap 827 may be used to attach any accessory (such as those depicted in FIGS. 33 and 34) to panel 840. For example, as shown in FIG. 35, binding screw 821 and second binding screw 825 pass through two holes of cash, passport, wallet holder 861 to then penetrate liner 844 and pegboard 842. Binding screw 821 and second binding screw 825 are then secured via binding screw cap 823 and a second binding screw cap 827, respectively, on the backside of panel 840. Thus, the interior compartment of the shelf device frame may be customized with a variety of accessories arranged in various configurations to accommodate any variety of firearms, ammunition, jewelry, documents, cash, heirlooms, and other valuables.

Locking System

Another aspect of the present invention is directed to a locking system that may be incorporated into a variety of articles of furniture, shelves, fixtures, and other storage devices to provide a concealed compartment for valuables. As depicted in the embodiments of the invention shown in FIGS. 6-7 and in FIGS. 21-22, the locking system of the present invention is generally comprised of a locking mechanism 500, a ledge 600, and a magnet 700. When the locking system of the present invention is used with a shelf device as described above, locking mechanism 500 may be attached to the interior side of any of the fixed members of the frame. For example, in the embodiments of the invention shown in FIGS.

1-7 and in FIGS. 16-22, locking mechanism 500 is attached to the bottomside of top member 150, and ledge 600 is attached to front member 130 (which is a moveable member and permanently adjoined to left side member 110, right side member 120, and bottom member 140). Ledge 600 is attached to the interior side of front member 130 so that ledge 600 is engaged with locking mechanism 500 while the shelf is in the closed position as shown in FIGS. 4 and 6 and in FIGS. 19 and 21; and ledge 600 is disengaged with locking mechanism 500 when the shelf is in the open position as shown in FIG. 7 and in FIG. 22.

Figure 10:
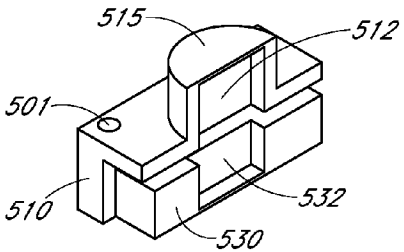
FIG. 10 depicts a perspective view of the locking mechanism shown in FIG. 8 with some parts omitted for clarity of illustration.
Figure 9:
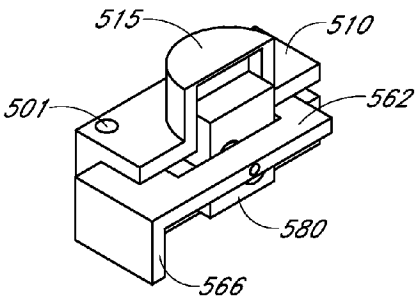
FIG. 9 depicts a perspective view of the locking mechanism shown in FIG. 8 with some parts omitted for clarity of illustration.
Figure 8:
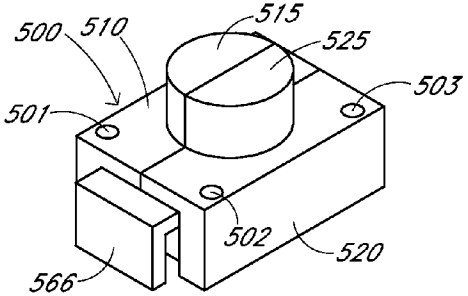
FIG. 8 depicts a perspective view of a locking mechanism in accordance with an embodiment of the present invention.
Figure 12:
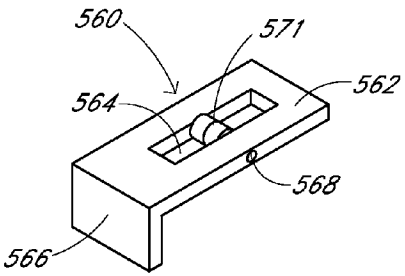
FIG. 12 depicts a perspective view of the slide bolt of the locking mechanism shown in FIG. 9.

FIGS. 8-13 depict a locking mechanism in accordance with one embodiment of the present invention. FIG. 8 depicts a perspective view of locking mechanism 500, while FIGS. 9-10 also depict a perspective view of locking mechanism 500 but with some parts omitted for clarity of illustration. Referring to FIGS. 8, 9, and 12, locking mechanism 500 generally comprises a housing, a slide bolt 560, and a magnetic lift 580 wherein slide bolt 560 and magnetic lift 580 are encased in said housing. As shown in FIGS. 8-10, the housing is comprised of: a first housing component 510, a second housing component 520, a third housing component 530, and a fourth housing component (not shown in the figures). First housing component 510 and second housing component 520 form the top and side portions of the housing wherein the side portions extend to the bottom of housing mechanism 500, and third housing component 530 and the fourth housing component are positioned underneath first housing component 510 and second housing component 520. Third housing component 530 and the fourth housing component are positioned below first housing component 510 and second housing component 520, respectively.

In other embodiments of the invention, first housing component 510 and third housing component 530 may differ in shape and structure than as shown in FIGS. 8-10, and first housing component 510 and third housing component 530 may collectively be manufactured as one housing component to form a left half of the housing. Thus, first housing component 510 and third housing component 530 can either be separate units adjoined to one another as shown in FIG. 10, or first housing component 510 and third housing component 530 may be manufactured to form one housing component. Similarly, second housing component 520 and the fourth housing component may differ in shape and structure than as shown in FIG. 8, and second housing component 520 and the fourth housing component may collectively be manufactured as one housing component to form a right half of the housing. Thus, second housing component 520 and the fourth housing component can either be separate units adjoined to one another, or second housing component 520 and the fourth housing component may be manufactured to form one housing component. In such embodiments, the left half of the housing (essentially formed by first housing component 510 positioned on top of third housing component 530) and the right half of the housing (essentially formed by second housing component 520 positioned on top of the fourth housing component) are then attached to one another after slide bolt 560 and magnetic lift 580 are placed therein during the production process. Thus, in alternate embodiments of the invention, the shapes, dimensions, positioning and configuration of first housing component 510, second housing component 520, third housing component 530, and/or the fourth housing component within housing mechanism 500 may differ; and the housing of locking mechanism 500 may be comprised of fewer or additional housing components (see e.g., FIGS. 23-24 which depict an embodiment of the invention in which the locking mechanism is comprised of two housing components as described in more detail below).

Referring back to the embodiment of the invention shown in FIG. 8, the housing of locking mechanism 500 includes a first hole 501, a second hole 502, a third hole 503, and a fourth hole (not shown) through which screws are inserted to secure locking mechanism 500 to an article of furniture, shelf device, fixture, or other structure with which the locking system of the present invention will be used. For instance, in the embodiment of the invention shown in FIGS. 1-7, locking mechanism 500 is attached to the bottomside of top member 150. First housing component 510 includes a first housing projection 515, and second housing component 520 includes a second housing projection 525. First housing projection 515 and second housing projection 525 are located on top of first housing component 510 and second housing component 520, respectively. First housing projection 515 and second housing projection 525 are used to better secure locking mechanism 500 by the insertion of first housing projection 515 and second housing projection 525 into the bottomside of top member 150. Thus, the bottomside of top member 150 includes a depression that is sized and shaped to receive first housing projection 515 and second housing projection 525. Additionally, first housing projection 515 and second housing projection 525 allow for locking mechanism 500 to be partially recessed within the bottomside of top member 150 so that locking mechanism 500 is not obstructive to the user when accessing the concealed compartment.

As illustrated in FIG. 10, first housing component 510 includes a first housing cavity 512, and third housing component 530 includes a third housing cavity 532. Although not shown in the figures, second housing component 520 and the fourth housing component also include respective cavities. First housing cavity 512 lies inside first housing projection 515, and third housing cavity 532 lies directly below first housing cavity 515. Said cavities accommodate the vertical movement of magnetic lift 580 which is illustrated in FIGS. 14-15 and discussed in more detail below.

Figure 11:
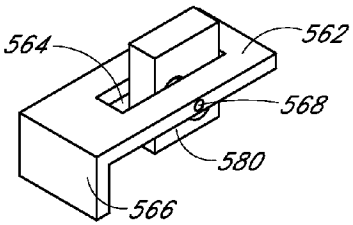
FIG. 11 depicts a perspective view of the slide bolt and magnetic lift of the locking mechanism shown in FIG. 9.

FIG. 11 depicts a perspective view of slide bolt 560 and magnetic lift 580 positioned within slide bolt 560, and FIG. 12 depicts a perspective view of slide bolt 560 without magnetic lift 580 positioned within slide bolt 560. Referring to FIG. 9 (which has omitted second housing component 520 to better illustrate slide bolt 560 and magnetic lift 580) and referring also to FIGS. 11-12, the housing partially encases slide bolt 560 which includes a body 562, a slit 564, a lip 566 that protrudes out of the housing (see FIGS. 8 and 14), and a pinhole 568 through which pin 573 is inserted through to hold magnetic lift 580. Lip 566 includes both (i) a downward portion that runs vertically downward and (ii) a top portion that runs horizontal and planar to body 562 and engages with ledge 600 when the locking system is in the locked position as depicted in FIG. 14. The top portion of lip 566 is engaged with ledge 600 when a horizontal portion of ledge 600 is resting on the top portion of lip 566 as shown in FIG. 14. Pin 573 is not shown in FIGS. 11-12 since it resides within pinhole 568 and roller 571 (although pin 573 is illustrated in the version of the locking mechanism depicted in FIG. 25). The rolling assembly of the locking mechanism is comprised of pin 573 and roller 571 and other versions of the invention may include additional rollers. Slide bolt 560 is positioned perpendicularly to magnetic lift 580. When locking mechanism 500 is being unlocked or locked, magnetic lift 580 moves in one direction to cause slide bolt 560 to move perpendicularly to the direction of magnetic lift 580 as slide bolt 560 ultimately disengages or engages with ledge 600 to unlock or lock the shelf, respectively (see also FIGS. 6-7)

Figure 13:
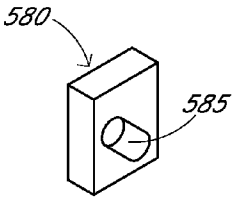
FIG. 13 depicts a perspective view of the magnetic lift of the locking mechanism shown in FIG. 9.

In the embodiment of the invention shown in FIGS. 8-13, slide bolt 560 is positioned horizontally and magnetic lift 580 is positioned vertically within the housing. Magnetic lift 580 is positioned perpendicularly inside slit 564 of slide bolt 560 so that slide bolt 560 and magnetic lift 580 are inter-engaged with one another. FIG. 13 depicts a perspective view of magnetic lift 580 which includes an aperture 585 through which pin 573 (see FIG. 25) and at least one roller 571 (see FIG. 12) reside to assist magnetic lift 580 to smoothly move vertically within slide bolt 560 and to assist slide bolt 560 to move horizontally. The rolling assembly of the locking mechanism is comprised of pin 573 and at least one roller 571. Referring to FIGS. 11-13, pinhole 568 of slide bolt 560 receives pin 573 on which roller 571 rotates. Aperture 585 of magnetic lift 580 may be oval in shape and configured at a 45 degree or other suitable angle in relation to slide bolt 560 to simultaneously permit the horizontal movement of slide bolt 560 and the vertical movement of magnetic lift 580.

Figure 14:
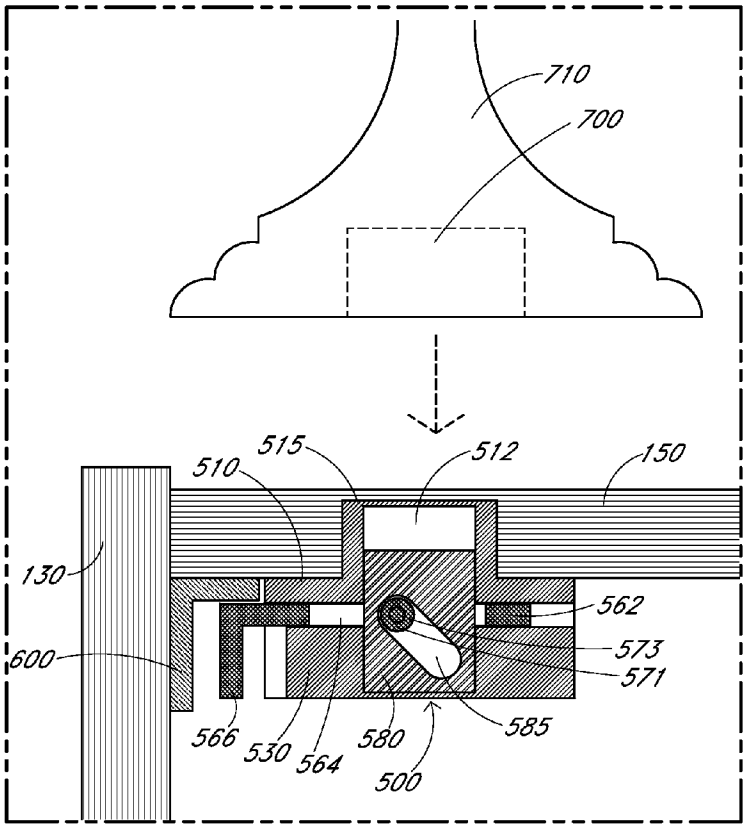
FIG. 14 depicts a portion of the view shown in FIG. 6 enlarged for magnification purposes and illustrates the locking system in the locked position.
Figure 15:
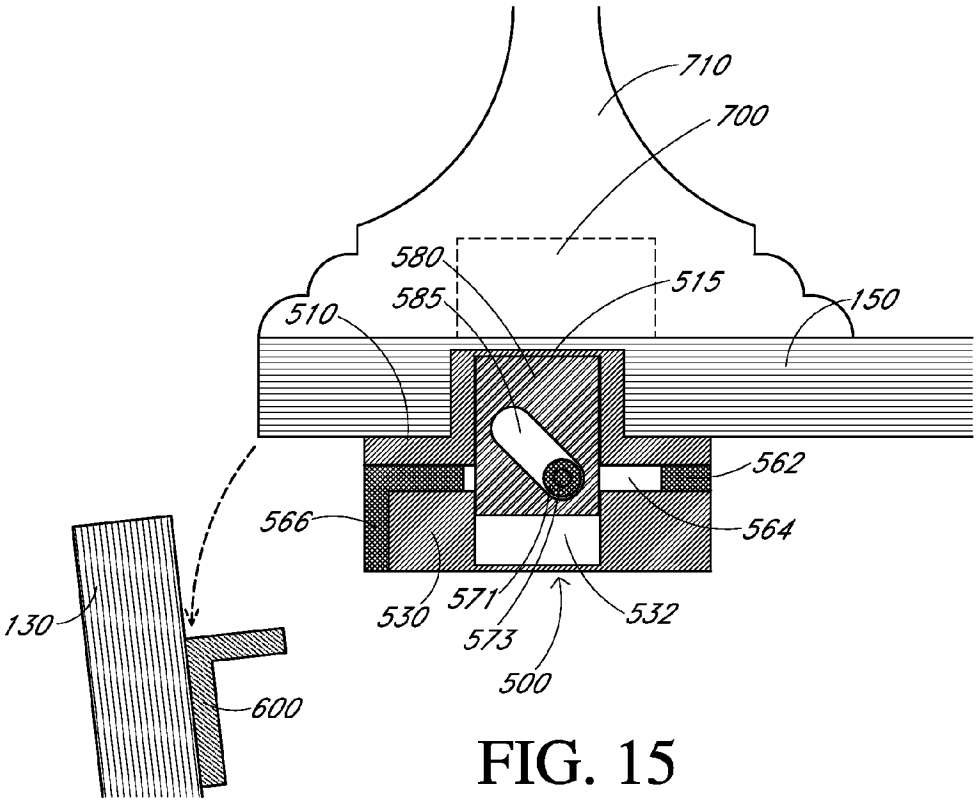
FIG. 15 depicts a view of the locking system as shown in FIG. 14, but illustrates the locking system in the unlocked position.

FIGS. 14 and 15 depict sectional views of the locking system of the present invention in the locked and unlocked position, respectively. The locking system depicted in FIGS. 14 and 15 is comprised of locking mechanism 500 that is depicted in FIGS. 8-13. The view shown in FIG. 14 is taken along line 6-6 of FIG. 1, and FIG. 14 depicts a portion of the view shown in FIG. 6 enlarged for magnification purposes to illustrate the locking system in the locked position. FIG. 15 depicts a view of the locking system as shown in FIG. 14, but illustrates the locking system in the unlocked position. As shown in both FIGS. 14 and 15, the locking system is comprised of locking mechanism 500, ledge 600, and magnet 700. Ledge 600 is attached to the interior side of front member 130. First housing component 510 is positioned on top of third housing component 530. Locking mechanism 500 is attached to the bottomside of top member 150, and the bottomside of top member 150 includes a depression in which first housing projection 515 is inserted such that locking mechanism 500 is partially recessed within top member 150. Additionally, magnetic lift 580 is positioned vertically inside of slit 564 and perpendicular to slide bolt body 562 which lies horizontally, and aperture 585 of magnetic lift 580 runs at a 45 degree angle in relation to slide bolt body 562 to simultaneously permit horizontal movement of slide bolt body 562 and vertical movement of magnetic lift 580.

In the locked position and as illustrated in FIG. 14, ledge 600 is engaged with lip 566 of slide bolt 560 wherein a horizontal portion of ledge 600 is resting on the top portion of lip 566, and the majority of slit 564 is positioned forward (i.e. in front of magnetic lift 580) when the locking system is in the locked position. As described hereinabove, lip 566 includes (i) a downward portion that runs vertically downward and (ii) a top portion that runs horizontal and planar to body 562 and engages with ledge 600 when the locking system is in the locked position as shown in FIG. 14. Furthermore, magnetic lift 580 occupies third housing cavity 532 (see also FIG. 10) and thus, first housing cavity 512 is partly vacant since magnetic lift 580 partly occupies first housing cavity 512 while the locking system is in the locked position as depicted in FIG. 14. The rolling assembly (roller 571 and pin 573) is positioned in the uppermost region of aperture 585 of magnetic lift 580 while locking mechanism 500 is in the locked position.

To unlock the locking system, a user would align magnet 700 (which can take a variety of inconspicuous forms as described in more detail below) with locking mechanism 500. In the embodiment of the invention illustrated in FIGS. 14-15, the user would align magnet 700 simply by placing it above locking mechanism 500 on top member 150 of the shelf frame. Thus, the user would have prior knowledge of the general location of locking mechanism 500 or may move magnet 700 along the surface of top member 150 until the user hears a distinct sound caused by the movement of magnetic lift 580 towards magnet 700. As illustrated in FIG. 15, magnet 700 pulls magnetic lift 580 vertically upward causing slide bolt body 562 to move horizontally backward to release slide bolt lip 566 from ledge 600. In some versions of the invention, slide bolt lip 566 is not immediately disengaged from ledge 600 upon alignment of magnet 700 with locking mechanism 500 to avoid inadvertent exposure of the concealed compartment, and the user would then have to move ledge 600 slightly upward (e.g., by moving front member 130 and/or bottom member 140 slightly upward) which slightly moves slide bolt lip 566 to allow it to completely disengage from ledge 600.

When the locking system is in the unlocked position as shown in FIG. 15, ledge 600 is disengaged with lip 566 such that the horizontal portion of ledge 600 is no longer resting on the top portion of lip 566, and the majority of slit 564 of slide bolt 560 is moved backward (i.e. behind magnetic lift 580) when the shelf is in the unlocked position. Thus, slide bolt 560 (which is comprised of slide bolt lip 566 and slide bolt body 562) is moved horizontally backward when the locking system is being unlocked. Since magnetic lift 580 is elevated by magnet 700, magnetic lift 580 occupies first housing cavity 512 (see also FIGS. 10 and 14) and therefore, third housing cavity 532 (which lies directly below first housing cavity 512) is partly vacant since magnetic lift 580 partly occupies third housing cavity 532 while the locking system is being unlocked as depicted in FIG. 15. The rolling assembly (roller 571 and pin 573) is then positioned in the lowermost region of aperture 585 of magnetic lift 580 while locking mechanism 500 is being unlocked. As a result, the shelf is opened as front member 130 (along with left side member 110, right side member 120, and bottom member 140 to which front member 130 is adjoined to as shown in FIGS. 2, 3, and 7) is released from top member 150 to expose the interior compartment.

The user then closes the shelf (by re-engaging the moveable members of the frame with the fixed members), and in variations of the invention in which slide bolt does not include lip 566 (as depicted in FIGS. 23-27), the user can then use magnet 700 to reposition slide bolt 560 to lock the frame in place as described in more detail below. In the self-locking variations of the invention as depicted in FIGS. 14-15, the user would simply close the shelf and the shelf would self-lock without the assistance of using magnet 700 to reposition slide bolt 560 to re-engage with ledge 600. In such variations of the invention, slide bolt 560 includes lip 566 at the front end of slide bolt body 562. Lip 566 is engaged with ledge 600 in the closed position, disengages with ledge 600 while the shelf is being unlocked and opened, and easily reengages with ledge 600 when the shelf is being closed.

Figure 25:
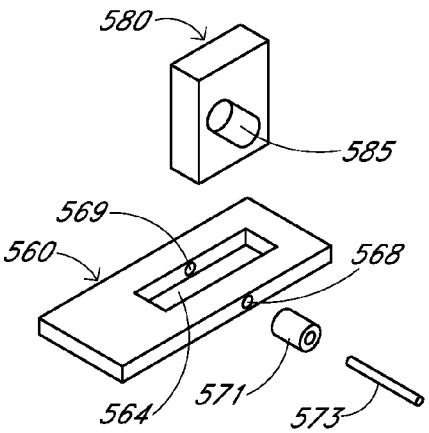
FIG. 25 depicts an exploded view of the slide bolt and magnetic lift of the locking mechanism shown in FIG. 23.
Figure 24:
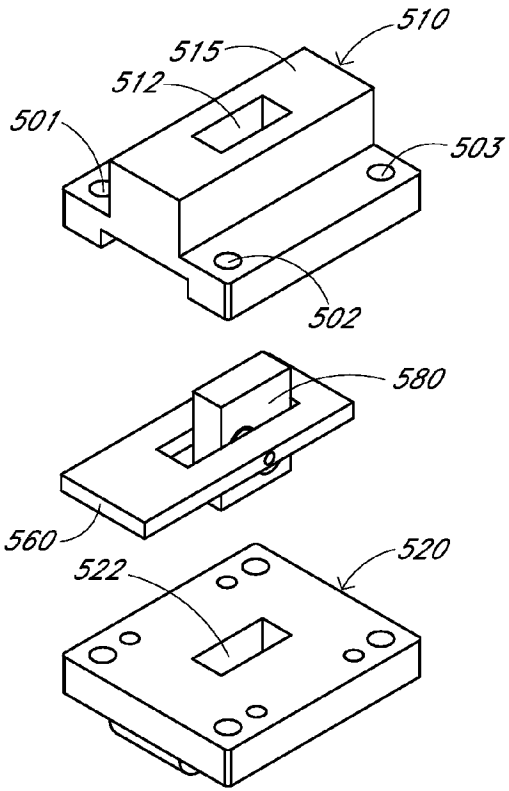
FIG. 24 depicts an exploded view of the locking mechanism shown in FIG. 23.
Figure 23:
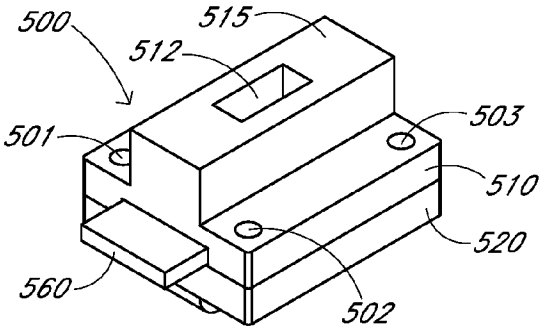
FIG. 23 depicts a perspective view of a locking mechanism in accordance with an embodiment of the present invention.

FIGS. 23-25 depict a locking mechanism in accordance with another embodiment of the present invention. FIG. 23 illustrates a perspective view of locking mechanism 500, and FIG. 24 illustrates an exploded view of locking mechanism 500. FIG. 25 illustrates an exploded view of slide bolt 560 and magnetic lift 580.

Referring to FIGS. 23-24, locking mechanism 500 comprises a housing, slide bolt 560, and magnetic lift 580 wherein slide bolt 560 and magnetic lift 580 are perpendicularly positioned with one another and are encased in said housing. The housing is comprised of first housing component 510 and second housing component 520. First housing component 510 is positioned on top of second housing component 520. The housing of locking mechanism 500 includes first hole 501, second hole 502, third hole 503, and a fourth hole (not shown) through which screws are inserted to secure locking mechanism 500 to an article of furniture, shelf device, fixture, or other structure in which the locking system of the present invention will be used. For instance, in the embodiment of the invention shown in FIGS. 16-22, locking mechanism 500 is attached to the bottomside of top member 150.

Figure 26:
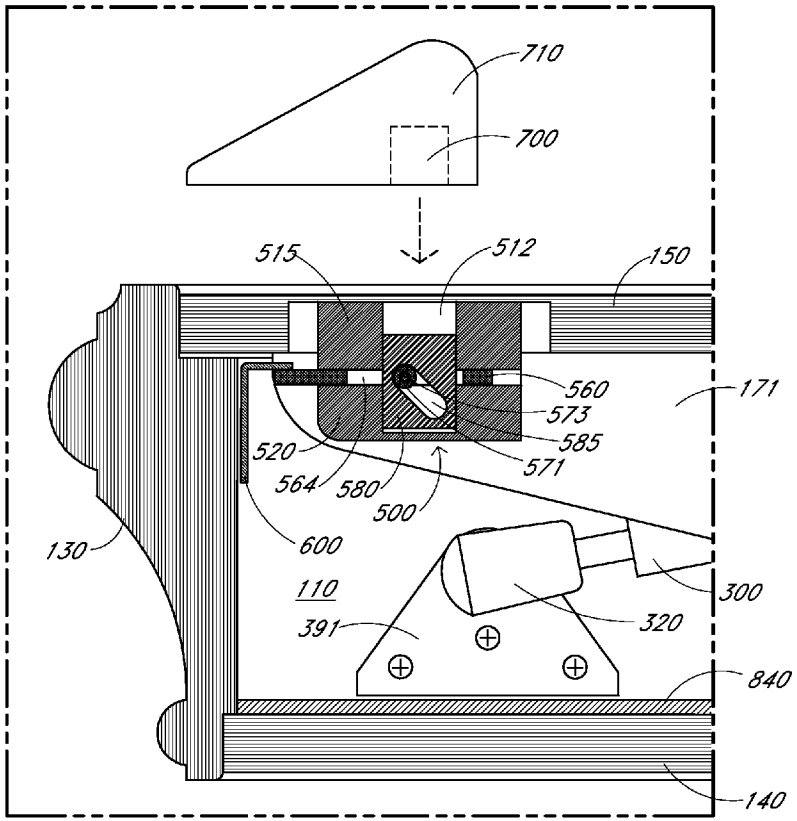
FIG. 26 depicts a portion of the view shown in FIG. 21 enlarged for magnification purposes and illustrates the locking system in the locked position.
Figure 27:
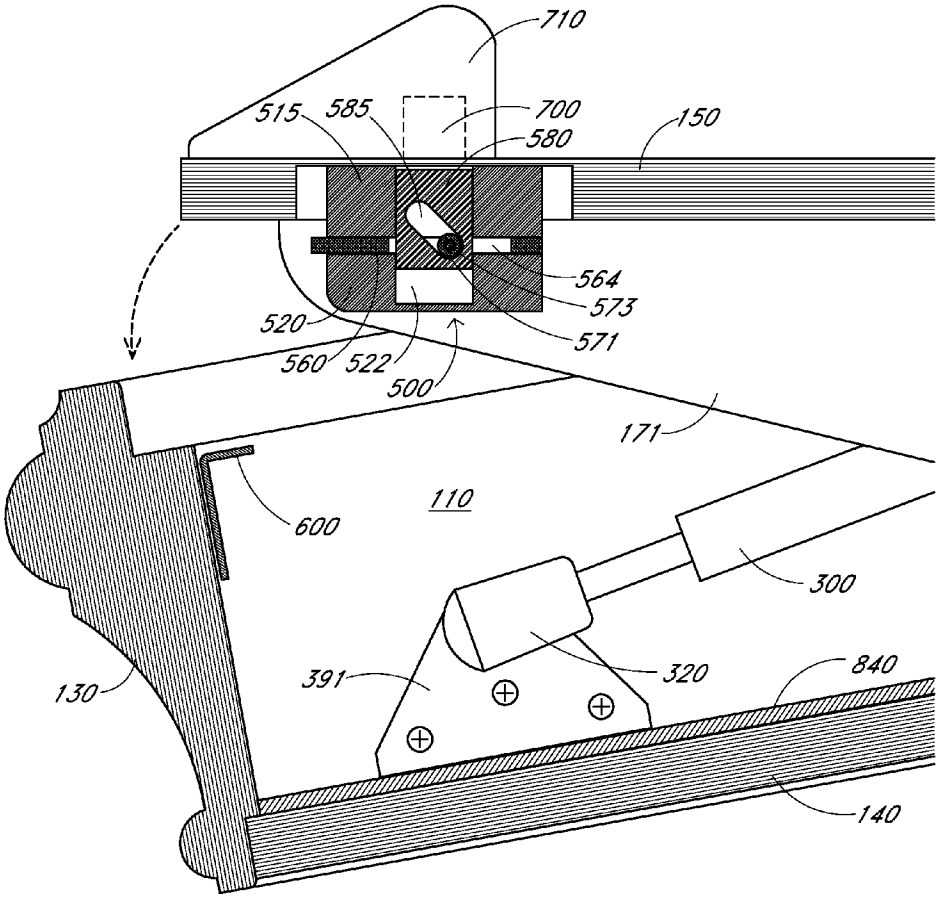
FIG. 27 depicts a view of the locking system as shown in FIG. 26, but illustrates the locking system in the unlocked position.

First housing component 510 includes first housing projection 515 which is located on top of first housing component 510. First housing projection 515 is used to better secure locking mechanism 500 by the insertion of first housing projection 515 into the bottomside of top member 150 as seen in FIGS. 26-27. Thus, the bottomside of top member 150 includes a depression that is sized and shaped to receive first housing projection 515. First housing projection 515 also allows for locking mechanism 500 to be partially recessed within the bottomside of top member 150 so that locking mechanism 500 is not obstructive to the user when accessing the concealed interior compartment. As illustrated in FIGS. 23-24, first housing component 510 further includes a first housing cavity 512 which lies within first housing projection 515, and second housing component 520 further includes a second housing cavity 522. First housing cavity 512 and second housing cavity 522 accommodate the vertical movement of magnetic lift 580 as illustrated in FIGS. 26-27 and discussed in more detail below. First housing component 510 may also include a horizontal depression to accommodate the movement of slide bolt 560 as shown on the bottom region of first housing component 510 in FIGS. 24, 26 and 27.

FIG. 24 illustrates how slide bolt 560 and magnetic lift 580 are positioned inside first housing component 510 and second housing component 520. Slide bolt 560 is positioned horizontally and magnetic lift 580 is positioned vertically within the housing, which is comprised of first housing component 510 and second housing component 520. Referring to FIGS. 24-25, magnetic lift 580 is positioned perpendicularly inside slit 564 of slide bolt 560 so that slide bolt 560 and magnetic lift 580 are inter-engaged with one another. Magnetic lift 580 includes an aperture 585 through which rolling assembly (pin 573 and at least one roller 571) resides to assist magnetic lift 580 to smoothly move vertically within slide bolt 560 and to thereby assist slide bolt 560 to move horizontally.

As shown in FIG. 25, slide bolt 560 includes pinhole 568 and a second pinhole 569 through which pin 573 is inserted through to hold magnetic lift 580. Pin 573 is also inserted through roller 571 such that pinhole 568 and second pinhole 569 are positioned on each side of roller 571. Pinhole 568 and second pinhole 569 of slide bolt 560 receive pin 573 on which roller 571 rotates. Aperture 585 of magnetic lift 580 may be oval in shape and configured at a 45 degree or other suitable angle in relation to slide bolt 560 to simultaneously permit the horizontal movement of slide bolt 560 and the vertical movement of magnetic lift 580.

When magnetic lift 580 is perpendicularly inter-engaged with slide bolt 560 (see FIG. 24), roller 571 resides within aperture 585 of magnetic lift 580 and assists with the smooth vertical movement of magnetic lift 580. Thus, pin 573 resides within pinhole 568, second pinhole 569, and roller 571 when magnetic lift 580 is inter-engaged with slide bolt 560. When locking mechanism 500 is being unlocked or locked, magnetic lift 580 moves in one direction to cause slide bolt 560 to move perpendicularly to the direction of magnetic lift 580 as slide bolt 560 ultimately disengages or engages with ledge 600 to unlock or lock the locking system, respectively as illustrated in FIGS. 26-27.

FIGS. 26 and 27 depict sectional views of the locking system of the present invention in the locked and unlocked position, respectively. The locking system depicted in FIGS. 26 and 27 is comprised of locking mechanism 500 that is illustrated in FIGS. 23-25. The view shown in FIG. 26 depicts a cross-sectional portion of the view shown in FIG. 21 enlarged for magnification purposes to illustrate the locking system in the locked position. FIG. 27 depicts a view of the locking system as shown in FIG. 26, but illustrates the locking system in the unlocked position. As shown in both FIGS. 26 and 27, the locking system includes locking mechanism 500, ledge 600, and magnet 700. Ledge 600 is attached to the interior side of front member 130. First housing component 510 is positioned on top of second housing component 520. Locking mechanism 500 is attached to the bottomside of top member 150, and the bottomside of top member 150 includes a depression in which first housing projection 515 is inserted such that locking mechanism 500 is partially recessed within the bottomside of top member 150. Additionally, magnetic lift 580 is positioned vertically inside of slit 564 and perpendicular to slide bolt 560 which lies horizontally, and aperture 585 of magnetic lift 580 runs at a 45 degree angle in relation to slide bolt 560 to simultaneously permit horizontal movement of slide bolt 560 and vertical movement of magnetic lift 580.

In the locked position and as illustrated in FIG. 26, ledge 600 is engaged with the tip of slide bolt 560, and the majority of slit 564 is positioned forward (i.e. in front of magnetic lift 580) when the locking system is in the locked position. In other words, slide bolt 560 is positioned forward. Furthermore, magnetic lift 580 occupies second housing cavity 522 (see also FIGS. 24 and 27) and thus, first housing cavity 512 is partly vacant since magnetic lift 580 partly occupies first housing cavity 512 while the locking system is in the locked position as depicted in FIG. 26. The rolling assembly (roller 571 and pin 573) is positioned in the uppermost region of aperture 585 of magnetic lift 580 while locking mechanism 500 is in the locked position.

To unlock the locking system, a user would align magnet 700 (which can take a variety of inconspicuous forms as described in more detail below) with locking mechanism 500. In the embodiment of the invention illustrated in FIGS. 26-27, the user would align magnet 700 simply by placing it above locking mechanism 500 on top member 150 of the shelf frame. Thus, the user would have prior knowledge of the general location of locking mechanism 500 and may move magnet 700 along the surface of top member 150 until the user hears a distinct sound caused by the sudden movement of magnetic lift 580 towards magnet 700. As illustrated in FIG. 27, magnet 700 pulls magnetic lift 580 vertically upward causing slide bolt 560 to move horizontally backward to release slide bolt 560 from ledge 600. In some versions of the invention, slide bolt 560 is not immediately disengaged from ledge 600 upon alignment of magnet 700 with locking mechanism 500 to avoid inadvertent exposure of the concealed compartment, and the user would then have to move ledge 600 slightly upward (e.g., by moving front member 130 and/or bottom member 140 slightly upward) which slightly moves slide bolt 560 to allow it to completely disengage from ledge 600.

When the locking system is in the unlocked position as shown in FIG. 27 and magnet 700 is in alignment with magnetic lift 580, ledge 600 is disengaged with slide bolt 560, and the majority of slit 564 of slide bolt 560 is shifted backward (i.e. behind magnetic lift 580) when the shelf is in the unlocked position. Thus, slide bolt 560 is moved horizontally backward when the locking system is being unlocked. Since magnetic lift 580 is elevated by magnet 700, magnetic lift 580 occupies first housing cavity 512 (see also FIGS. 24 and 26), and therefore, second housing cavity 522 (which lies directly below first housing cavity 512) is partly vacant since magnetic lift 580 partly occupies second housing cavity 522 while the locking system is being unlocked as depicted in FIG. 27. The rolling assembly (roller 571 and pin 573) is then positioned in the lowermost region of aperture 585 of magnetic lift 580 while locking mechanism 500 is being unlocked and magnet 700 is in alignment with magnetic lift 580. As a result, the shelf is opened as front member 130 (along with left side member 110, right side member 120, and bottom member 140 to which front member 130 is permanently adjoined to as shown in FIGS. 17, 18, and 22) is released from top member 150 to expose the interior compartment.

The user then closes the shelf (by re-engaging the moveable members of the frame with the fixed members) by using magnet 700 to reposition slide bolt 560 so that it can re-engage with ledge 600. To accomplish this, the user would: align magnet 700 with locking mechanism 500 such that magnetic lift 580 is pulled upward (as the user would do when unlocking the locking mechanism); close the interior compartment (by reengaging the moveable members of the frame with the fixed members), and slide magnet 700 away from locking mechanism 500 while holding the interior compartment in the closed position. Since magnet 700 is comprised of a rare earth magnet of industrial strength, magnet 700 is ideally slid away from locking mechanism 500 instead of being pulled off which would require substantial force. When magnet 700 is slid/moved away from locking mechanism 500, magnetic lift 580 is dropped down (into second housing cavity 522) moving slide bolt 560 forward to reengage with ledge 600. Slide bolt 560 stays engaged with ledge 600 until magnet 700 is used again to unlock the locking system. Thus, slide bolt 560 is engaged with ledge 600 when the locking system is in the locked position (interior compartment is in the closed position), disengages with ledge 600 while the locking system is being unlocked (interior compartment is being opened), and reengages with ledge 600 by using magnet 700 to reposition slide bolt 560 to relock the locking system (reclose interior compartment).

In other embodiments, the locking system may be comprised of multiple locking mechanisms and ledges, and some versions may even employ multiple magnets. For example, in the embodiment of the invention that is depicted in FIGS. 28-32 and described above, the locking system is comprised of locking mechanism 500, a second locking mechanism 550, ledge 600, a second ledge 620, and at least one magnet 700. When the locking system in such embodiments is locked, locking mechanism 500 and second locking mechanism 550 are engaged with ledge 600 and second ledge 620, respectively. When the locking system is unlocked, locking mechanism 500 and second locking mechanism 550 are disengaged from ledge 600 and second ledge 620 either simultaneously by aligning two magnets with locking mechanism 500 and second locking mechanism 550 or are disengaged one at a time by one using one magnet. The manner of disengagement of locking mechanism 500 from ledge 600 and of second locking mechanism 550 from second ledge 620 operates in the same manner as described in the embodiments shown in FIGS. 14-15 or in FIGS. 21-22 as described above.

To operate the locking system of the present invention, a specific type of magnet 700 such as a rare earth magnet is placed on the surface of top member 150 in direct alignment with magnetic lift 580 as described above and depicted in FIGS. 14-15 and in FIGS. 26-27. Magnetic lift 580 may be comprised of any suitable magnetic material such as steel so that it responds to magnet 700. However, slide bolt 560 is comprised of a non-magnetic material (e.g., aluminum) so that it is not affected by the use of magnet 700. Magnet 700 is preferably of a type and a ferromagnetic strength, that the average magnet does not possess, to effectively engage and disengage the locking mechanism 500 from ledge 600. Magnet 700 is preferably of the type that is not readily accessible to the ordinary person due to its availability and expense. For example, in a preferred embodiment of the present invention, magnet 700 is comprised of a rare earth magnet or is formed from alloys of rare earth metals that are mined from the earth's crust (such as Praseodymium, Neodymium, Samarium, Gadolinium, and Dysprosium), which create a strong magnetic field in comparison to the average magnet in order to prevent unauthorized access to the interior compartment and its contents through use of a low strength average magnet that are easily accessible from retail stores. Rare earth metals are most commonly used in the manufacturing of electronics and, therefore, are not readily available to the ordinary consumer in a form capable of being used for the function of magnet 700 as described herein. Rare earth magnets are of industrial strength and are not typically obtainable at typical hardware stores and other retail outlets making it more difficult for thieves and other persons from obtaining unauthorized accesses to the interior compartment.

In addition, magnet 700 may be concealed by decorative structure 710 (see FIGS. 14-15 and FIGS. 26-27). Decorative structure 710 may be comprised of any decorative or household item commonly found on shelves such as a candlestick, candle, vase, clock, plant, pot, book, bookend, figurine, statute, lamp base, picture frame, stereo speaker, etc. The user could simply attach magnet 700 to the bottom or other suitable location of the user's own decorative structure 710 (e.g., candlestick) to conceal magnet 700. Alternatively, magnet 700 and decorative structure 710 may be manufactured as one unit. In such embodiments, magnet 700 is pre-attached permanently as part of decorative structure 710. Magnet 700 is preinstalled within a finished decorative structure 710 that can take any suitable shape, form, and dimension. For example decorative structure 710 is comprised of a wedge shape as shown in FIGS. 26-27. The unit comprised of magnet 700 attached to decorative structure 710 can be stored inconspicuously on top of the shelf device of the present invention (or on top of the article of furniture, fixture, or container for which the locking system will be used) for immediate access to the interior compartment. Consequently, the intense strength and limited accessibility of rare earth magnet 700 and the ability to easily conceal magnet 700 within decorative structure 710 allow it to act as an inconspicuous key to lock and unlock the locking system of the present invention.

The locking system of the present invention is not limited for use with shelf devices as discussed in some embodiments of the present invention and as shown in the figures. In fact, the locking system of the present invention has a wide array of applications. For example, it can be incorporated and used with different articles of furniture, fixtures, cabinets, containers, or any other item that provides a secret interior compartment. The locking system is undetectable and does not alert thieves and unauthorized person that a secret compartment exists since (a) the locking system is attached to the interior (and is thus hidden) of any article of the furniture, shelf, fixtures, cabinets, containers, or any other item that offers a secret interior compartment; (b) the locking system incorporates a powerful rare earth magnet that acts like a key to lock and unlock the locking system even if the magnetic lift of the locking mechanism is hidden underneath a layer of wood or other material; and (c) the rare earth magnet key can easily and discreetly be concealed in practically any decorative or household item.

EXAMPLES

In the foregoing description of embodiments of the invention, reference was made to the accompanying figures, which form a part of this application. The figures show, by way of illustration, certain embodiments in which the invention may be practiced. It is to be understood that other variations are possible and modifications may be made without departing from the scope of the present invention. A variety of embodiments are possible wherein each embodiment includes a different combination of the different aspects and elements of the present invention.

For example, in one embodiment, a shelf device is comprised of a frame and a locking system. The frame comprise a left side member, a right side member, a front member, a bottom member, a top member, and a back member wherein the left side member, the right side member, the front member, the bottom member, the top member, and the back member are configured to form an interior compartment comprised of a rectangular prism shape. The locking system is comprised of a locking mechanism, ledge, and magnet. The locking mechanism is attached to the bottomside of the top member and comprises a slide bolt that includes a slit, a magnetic lift positioned inside the slit, and a housing that encases the slide bolt and the magnetic lift. The ledge is attached to the interior side of the front member, and the ledge is engaged with the slide bolt when the locking system is locked. The magnet, which may be comprised of a rare earth magnet, unlocks the locking system by causing the slide bolt to disengage from the ledge to release the front member from the top member and expose the interior compartment. The frame may further include at least one hinge attached between the bottom member and the back member, and the front member may be permanently adjoined to the bottom member. In another variation, the frame further includes at least one hinge attached between the bottom member and the back member, and the front member, the left side member, and the right side member are permanently adjoined to the bottom member. The frame may further include a first arm and a second arm that are attached underneath the top member such that the first arm is positioned along the left side member and the second arm is positioned along the right side member. In such versions of the invention, the shelf device may further include a piston comprised of a stationary end attached to the first arm and a telescoping end attached to the interior side of the left side member.

In another example, an alternate embodiment of the invention is directed to a shelf device is comprised of a frame and a locking system. The frame includes a left side member, a right side member, a front member, a bottom member, a top member, a back member, a first hinge, and a second hinge wherein the first hinge and the second hinge are attached between the back member and the bottom member. The left side member, the right side member, the front member, the bottom member, the top member, and the back member are configured to form an interior compartment comprised of a rectangular prism shape. Additionally, the left side member, the right side member, and the front member are permanently adjoined to the bottom member. The locking system is comprised of a locking mechanism, a ledge, and a rare earth magnet that unlocks the locking system. The locking mechanism is attached to the bottomside of the top member and includes a slide bolt that includes a slit, a magnetic lift positioned inside the slit, and a housing that encases the slide bolt and the magnetic lift. The ledge is attached to the interior side of the front member wherein the ledge is engaged with the slide bolt when the locking system is locked. The rare earth magnet unlocks the locking system by causing the slide bolt to disengage from the ledge to collectively release the left side member, the right side member, the front member, and the bottom member away from the top member and thereby expose the interior compartment. In some versions, the interior compartment may include a removable panel comprised of a pegboard to secure contents inside the interior compartment. The pegboard of the removable panel also allows for the customization of the interior compartment to accommodate a variety of firearms, ammunition, jewelry, documents and other valuables. The frame may further include a mounting cleat for mounting the shelf device to a wall wherein the mounting cleat attaches to the rearside of the back member. Yet, in another variation, the frame further comprises a first arm and a second arm that are attached underneath the top member wherein the first arm is positioned along the left side member and the second arm is positioned along the right side member, and the shelf device also includes a piston comprised of a stationary end attached to the first arm and a telescoping end attached to the interior side of the left side member. The shelf device further may further include a second piston comprised of a second piston stationary end attached to the second arm and a second piston telescoping end attached to the interior side of the right side member. In additional variations of the invention, the shelf device may include a second locking system. In one version, the second locking system is comprised of a second locking mechanism attached to the bottomside of the top member and includes a second slide bolt that includes a second slit, a second magnetic lift positioned inside the second slit, and a second housing that encases the second slide bolt and the second magnetic lift; a second ledge attached to the interior side of the front member wherein the second ledge is engaged with the second slide bolt when the second locking system is locked and wherein the rare earth magnet described above unlocks the second locking system. In another version, the second locking system is comprised of a second locking mechanism attached to the bottomside of the top member and includes a second slide bolt that includes a second slit, a second magnetic lift positioned inside the second slit, and a second housing that encases the second slide bolt and the second magnetic lift; a second ledge attached to the interior side of the front member wherein the second ledge is engaged with the second slide bolt when the second locking system is locked; and a second rare earth magnet that unlocks the second locking system by causing the second slide bolt to disengage from the second ledge.

In a further example, a locking system is comprised of (a) a locking mechanism including a slide bolt that includes a slit, a magnetic lift that includes an aperture that runs diagonally across the magnetic lift wherein the magnetic lift is positioned inside the slit, a rolling assembly that includes a roller and a pin inserted through the roller wherein the rolling assembly runs laterally across the slit and through the aperture and moves the slide bolt perpendicularly to the movement of the magnetic lift; and a housing that encases the slide bolt, the magnetic lift, and the rolling assembly; (b) a ledge that is engaged with the slide bolt when the locking system is locked; and © a rare earth magnet that unlocks the locking system by pulling the magnetic lift causing the slide bolt to disengage from the ledge. In some versions, the magnetic lift moves vertically and the slide bolt moves horizontally. The housing may be comprised of a first housing component and a second housing component wherein the first housing component is positioned on top of the second housing component. The first housing component may include a first housing cavity and the second housing component may include a second housing cavity wherein the first housing cavity is aligned with the second housing cavity to accommodate movement of the magnetic lift. The first housing component may also include a horizontal depression to accommodate movement of the slide bolt. The slide bolt may include a first pinhole and a second pinhole, and the rolling assembly is attached to the slide bolt by inserting the pin into the first pinhole and the second pinhole. The rolling assembly may include one or more additional rollers in other versions of the invention.

Although the present invention has been described above in considerable detail with reference to certain versions thereof, other versions are possible. Many of the elements of the invention may be of any suitable shape, size, and/or configuration; may further include structures not described hereinabove; may exclude one or more components described above, and may be positioned at alternate suitable locations within the device without departing from the spirit and scope of the present invention. In addition, the materials of the elements may vary in different embodiments of the invention.

The attached figures depicting various embodiments of the invention are primarily intended to convey the basic principles embodied in the present invention. Thus, the present invention may further include additional structures and features not illustrated in the figures. Also, various structures of the present invention such as the dimensions, shapes, and configuration of shelf device frame members may be customized to accommodate a particular firearm or item to be stored within the shelf device. The present invention can also be used with, mounted onto, or incorporated into a variety of other existing fixtures or furniture such as an additional shelf to a bookcase or to provide a secret compartment underneath tabletops, desks, behind headboards, underneath bedframes, hidden within other cabinetry or other fixtures, etc.

While the description above refers to particular embodiments of the present invention, it will be understood that many modifications may be made without departing from the spirit thereof. The presently disclosed embodiments are therefore to be considered in all respects as illustrative and not restrictive.

What is claimed is:

1. A shelf device comprising:

a frame comprised of a left side member, a right side member, a front member including an interior side, a bottom member, a top member including a bottomside, a back member wherein the left side member, the right side member, the front member, the bottom member, the top member, and the back member are configured to form an interior compartment comprised of a rectangular prism shape wherein the interior side of the front member and the bottomside of the top member face the interior compartment, and at least one hinge attached between the bottom member and the back member and wherein the front member is permanently adjoined to the bottom member; and a locking system comprised of a locking mechanism attached to the bottomside of the top member, the locking mechanism comprising a slide bolt that includes a slit, a magnetic lift positioned inside the slit, and a housing that partially encases the slide bolt and the magnetic lift, a ledge attached to the interior side of the front member wherein the ledge is engaged with the slide bolt when the locking system is locked, and a magnet that unlocks the locking system by causing the slide bolt to disengage from the ledge to release the front member from the top member and expose the interior compartment.

2. A shelf device comprising:

a frame comprised of a left side member, a right side member, a front member including an interior side, a bottom member, a top member including a bottomside, a back member wherein the left side member, the right side member, the front member, the bottom member, the top member, and the back member are configured to form an interior compartment comprised of a rectangular prism shape wherein the interior side of the front member and the bottomside of the top member face the interior compartment, and at least one hinge attached between the bottom member and the back member and wherein the front member, the left side member, and the right side member are permanently adjoined to the bottom member; and a locking system comprised of a locking mechanism attached to the bottomside of the top member, the locking mechanism comprising a slide bolt that includes a slit, a magnetic lift positioned inside the slit, and a housing that partially encases the slide bolt and the magnetic lift, a ledge attached to the interior side of the front member wherein the ledge is engaged with the slide bolt when the locking system is locked, and a magnet that unlocks the locking system by causing the slide bolt to disengage from the ledge to release the front member from the top member and expose the interior compartment.

3. A shelf device comprising:

a frame comprised of a left side member including a left member interior side, a right side member including a right member interior side, a front member including a front member interior side, a bottom member, a top member including a bottomside, a back member including a rearside wherein the left side member, the right side member, the front member, the bottom member, the top member, and the back member are configured to form an interior compartment comprised of a rectangular prism shape wherein the left member interior side, the right member interior side, the front member interior side, and the bottomside of the top member face the interior compartment and wherein the left side member, the right side member, and the front member are permanently adjoined to the bottom member, a first hinge, and a second hinge wherein the first hinge and the second hinge are attached between the back member and the bottom member; and a locking system comprised of a locking mechanism attached to the bottomside of the top member, the locking mechanism comprising a slide bolt that includes a slit, a magnetic lift positioned inside the slit, and a housing that partially encases the slide bolt and the magnetic lift, a ledge attached to the front member interior side wherein the ledge is engaged with the slide bolt when the locking system is locked, and a rare earth magnet that unlocks the locking system by causing the slide bolt to disengage from the ledge to collectively release the left side member, the right side member, the front member, and the bottom member away from the top member and expose the interior compartment.

4. The shelf device of claim 3 wherein the interior compartment includes a removable panel comprised of a pegboard to secure contents inside the interior compartment wherein the removable panel is positioned on top of the bottom member.

5. The shelf device of claim 3 wherein the frame further comprises a mounting cleat for mounting the shelf device to a wall wherein the mounting cleat attaches to the rearside of the back member.

6. The shelf device of claim 3 wherein the frame further comprises a first arm and a second arm that are attached underneath the top member wherein the first arm is positioned along the left side member and the second arm is positioned along the right side member and wherein the shelf device further comprises a piston comprised of a stationary end attached to the first arm and a telescoping end attached to the left member interior side.

7. The shelf device of claim 6 wherein the shelf device further comprises a second piston comprised of a second piston stationary end attached to the second arm and a second piston telescoping end attached to the right member interior side.

8. The shelf device of claim 3 further comprising a second locking system comprised of a second locking mechanism attached to the bottomside of the top member, the second locking mechanism comprising a second slide bolt that includes a second slit, a second magnetic lift positioned inside the second slit, and a second housing that partially encases the second slide bolt and the second magnetic lift, and a second ledge attached to the front member interior side wherein the second ledge is engaged with the second slide bolt when the second locking system is locked and wherein the rare earth magnet unlocks the second locking system.

9. The shelf device of claim 3 further comprising a second locking system comprised of a second locking mechanism attached to the bottomside of the top member, the second locking mechanism comprising a second slide bolt that includes a second slit, a second magnetic lift positioned inside the second slit, and a second housing that partially encases the second slide bolt and the second magnetic lift, a second ledge attached to the front member interior side wherein the second ledge is engaged with the second slide bolt when the second locking system is locked; and a second rare earth magnet that unlocks the second locking system by causing the second slide bolt to disengage from the second ledge.

10. A locking system comprising:

a locking mechanism comprised of a slide bolt that includes a slit, a magnetic lift that includes an aperture that runs diagonally across the magnetic lift wherein the magnetic lift is positioned inside the slit, a rolling assembly that includes a roller and a pin inserted through the roller wherein the rolling assembly runs laterally across the slit and through the aperture and moves the slide bolt perpendicularly to the movement of the magnetic lift; and a housing that partially encases the slide bolt, the magnetic lift, and the rolling assembly;

a ledge that is engaged with the slide bolt when the locking system is locked; and a rare earth magnet that unlocks the locking system by pulling the magnetic lift causing the slide bolt to disengage from the ledge.

11. The locking system of claim 10 wherein the magnetic lift moves vertically and the slide bolt moves horizontally.

12. The locking system of claim 10 wherein the housing is comprised of a first housing component and a second housing component wherein the first housing component is positioned on top of the second housing component.

13. The locking system of claim 12 wherein the first housing component includes a first housing cavity and the second housing component includes a second housing cavity wherein the first housing cavity is aligned with the second housing cavity to accommodate movement of the magnetic lift.

14. The locking system of claim 12 wherein the first housing component includes a horizontal depression to accommodate movement of the slide bolt.

15. The locking system of claim 10 wherein the slide bolt comprises a first pinhole and a second pinhole and the rolling assembly is attached to the slide bolt by inserting the pin into the first pinhole and the second pinhole.

16. The locking system of claim 10 wherein the rolling assembly further includes one or more additional rollers wherein the pin is inserted through the one or more additional rollers.

* * * * *